US010802431B2

(12) United States Patent
Adachi et al.

(10) Patent No.: US 10,802,431 B2
(45) Date of Patent: Oct. 13, 2020

(54) HEATING DEVICE, FIXING DEVICE, AND IMAGE FORMING APPARATUS

(71) Applicants: Tomoya Adachi, Kanagawa (JP); Yuusuke Furuichi, Kanagawa (JP); Yukimichi Someya, Saitama (JP)

(72) Inventors: Tomoya Adachi, Kanagawa (JP); Yuusuke Furuichi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/585,172

(22) Filed: Sep. 27, 2019

(65) Prior Publication Data

US 2020/0103799 A1 Apr. 2, 2020

(30) Foreign Application Priority Data

Sep. 28, 2018 (JP) ..... 2018-184421

(51) Int. Cl.
*G03G 15/20* (2006.01)

(52) U.S. Cl.
CPC ..... *G03G 15/2053* (2013.01); *G03G 15/2039* (2013.01); *G03G 2215/2019* (2013.01)

(58) Field of Classification Search
CPC ..... G03G 15/2053; G03G 15/2039; G03G 2215/2019
See application file for complete search history.

(56) References Cited

U.S. PATENT DOCUMENTS

2015/0139708 A1* 5/2015 Shimura ..... G03G 15/2053 399/329
2015/0227091 A1* 8/2015 Ando ..... G03G 15/2053 399/33
2018/0284664 A1* 10/2018 Imaizumi ..... G03G 15/2053
2018/0335731 A1* 11/2018 Ogura ..... G03G 15/2053
2019/0278206 A1 9/2019 Adachi et al.
2019/0286026 A1 9/2019 Furuichi et al.
2019/0286028 A1 9/2019 Furuichi et al.
2019/0286029 A1 9/2019 Adachi et al.

FOREIGN PATENT DOCUMENTS

JP 5-100589 4/1993
JP 5-205851 8/1993
JP 6-176850 6/1994
JP 2002-359059 12/2002
JP 2007-232819 9/2007
JP 2014-026815 2/2014
(Continued)

OTHER PUBLICATIONS

U.S. Appl. No. 16/391,959, filed Apr. 23, 2019 Takamasa Hase, et al.

(Continued)

*Primary Examiner* — Sophia S Chen
(74) *Attorney, Agent, or Firm* — Oblon, McClelland, Maier & Neustadt, L.L.P.

(57) ABSTRACT

A heating device includes a heater and an interrupting portion. The heater extends in a width direction of a rotary belt and configured to contact and heat the belt. The interrupting portion is configured to interrupt power supply at a longitudinal end portion of the heater.

16 Claims, 22 Drawing Sheets

(56) References Cited

FOREIGN PATENT DOCUMENTS

| | | |
|---|---|---|
| JP | 2015-194713 | 11/2015 |
| JP | 2016-018127 | 2/2016 |

OTHER PUBLICATIONS

U.S. Appl. No. 16/520,409, filed Jul. 24, 2019 Hiroshi Yoshinaga, et al.
U.S. Appl. No. 16/451,512, filed Jun. 25, 2019 Tomoya Adachi, et al.
U.S. Appl. No. 16/519,254, filed Jul. 23, 2019 Daisuke Inoue, et al.
U.S. Appl. No. 16/502,348, filed Jul. 3, 2019 Yuusuke Furuichi, et al.
U.S. Appl. No. 16/502,473, filed Jul. 3, 2019 Yuusuke Furuichi, et al.

* cited by examiner (a)

(b)

(c)

(a)

(b)

(c)

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-184421, filed on Sep. 28, 2018, in the Japan Patent Office, the entire disclosure of which is incorporated by reference herein.

BACKGROUND

Technical Field

Aspects of the present disclosure relate to a heating device using a heater, a fixing device, and an image forming apparatus.

Related Art

Various types of fixing devices used in electrophotographic image forming apparatuses are known. One of those is a type in which a thin fixing belt having a low heat capacity is heated by a heater. As this heater, a heater in which a resistive heat generator is disposed on a base disposed in the width direction of the fixing belt is used.

The fixing belt tends to be thinner due to energy saving, lower cost, and higher speed. However, when the thickness is reduced, damage such as cracks and rounds tend to be generated at the end portion of the belt. When the belt is damaged, the belt shifts toward the damaged side, and the end portion of the heater is exposed on the side opposite to the shifted movement to cause a rapid increase in the temperature of the end portion of the heater.

A temperature sensor is disposed on the back surface of the base of the heater, and a current to be supplied to the heater is controlled by a power controller based on a signal from the temperature sensor. When the temperature of the end portion of the heater rapidly increases as described above, the electric power controller interrupts the power supply to the heater to ensure safety.

SUMMARY

In an aspect of the present disclosure, there is provided a heating device includes a heater and an interrupting portion. The heater extends in a width direction of a rotary belt and configured to contact and heat the belt. The interrupting portion is configured to interrupt power supply at a longitudinal end portion of the heater.

In another aspect of the present disclosure, there is provided a fixing device that includes a fixing belt, the heating device, and a pressure member. The heating device is configured to heat the fixing belt. The pressure member is disposed to face the heating device across the fixing belt.

In still another aspect of the present disclosure, there is provided an image forming apparatus that includes the fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
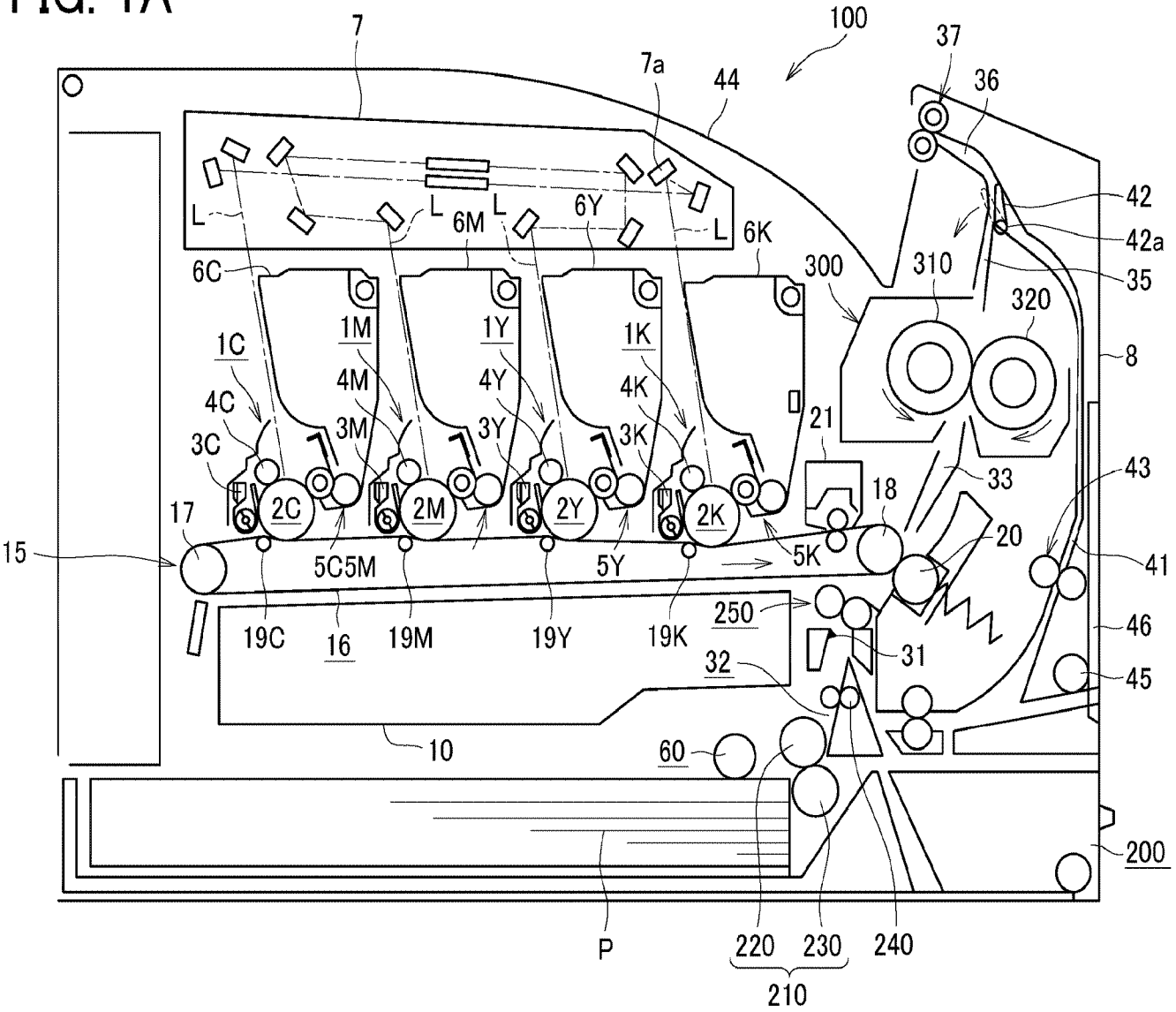
FIG. 1A is a schematic configuration view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a heating device according to an embodiment of the present disclosure, a fixing device using the heating device, and an image forming apparatus (laser printer) will be described with reference to the drawings. The laser printer is an example of an image forming apparatus, and it goes without saying that the image forming apparatus is not limited to a laser printer. That is, the image forming apparatus can be any one of a copying machine, a facsimile machine, a printer, a printing machine, and an ink jet recording apparatus, or a multifunction peripheral in which at least two of these are combined.

In addition, the same numeral is attached to the same or corresponding portion in each figure, and a repeated description is simplified or omitted as appropriate. Further, dimensions, materials, shapes, relative arrangements, and the like in the description of each component are illustrative, and the scope of the present disclosure is not limited to these unless otherwise specified.

In the following embodiment, "recording medium" is described as "paper", but "recording medium" is not limited to paper (sheet). The "recording medium" includes not only paper (sheet) but also an overhead projector (OHP) sheets, fabrics, metal sheets, plastic films, and prepreg sheets obtained by impregnating carbon fibers with a resin in advance.

A medium to which a developer or ink can be attached, a recording paper, and a recording sheet are all included in the "recording medium". The "sheet" includes cardboard, postcard, envelope, thin paper, coated paper (coat paper, art paper, etc.), and tracing paper in addition to plain paper.

Further, the "image formation" used in the following description means not only that an image having a meaning such as a character or a figure is imparted to the medium, but also an image having no meaning such as a pattern is imparted to the medium.

Configuration of Laser Printer

Figure 1B:
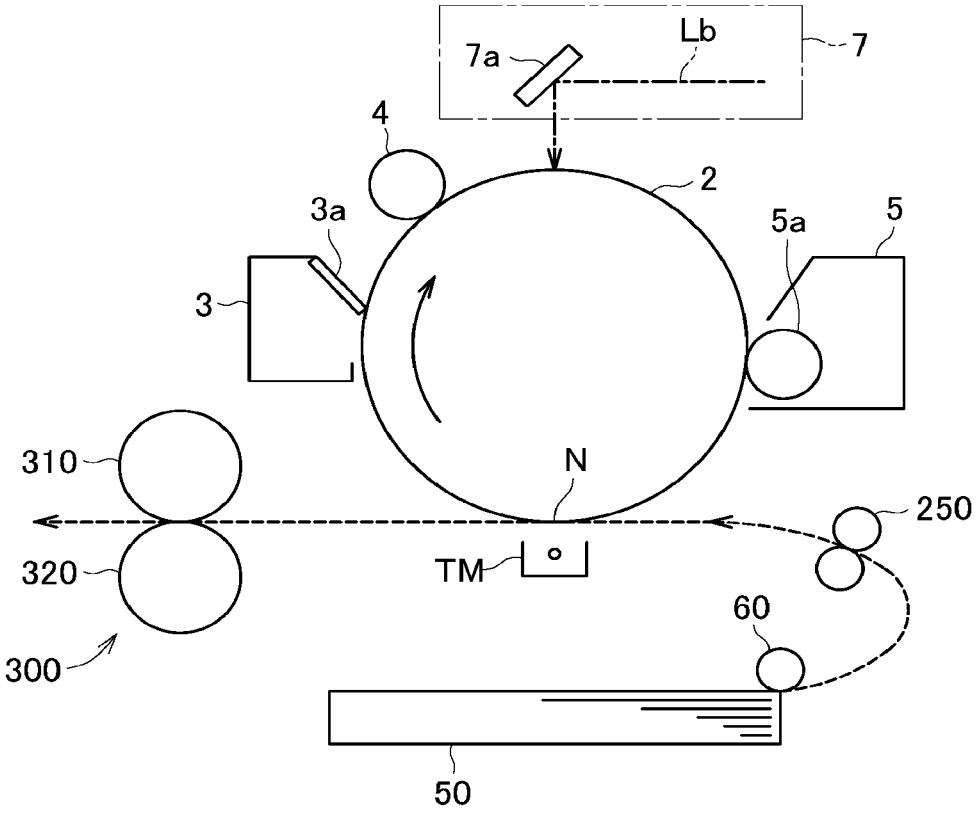
FIG. 1B is a principle diagram of an image forming apparatus according to an embodiment of the present disclosure.

FIG. 1A is a configuration view schematically illustrating a configuration of a color laser printer as an example of an image forming apparatus 100, including a heating device and a fixing device 300, according to an embodiment of the present disclosure. FIG. 1B illustrates a simplified principle of the color laser printer.

The image forming apparatus 100 includes four process units 1K, 1Y, 1M, and 1C as image former. These process units form an image with each color developer of black (K), yellow (Y), magenta (M), and cyan (C) corresponding to color separation components of a color image.

The process units 1K, 1Y, 1M, and 1C have the same configuration except that the process units 1K, 1Y, 1M, and 1C include toner bottles 6K, 6Y, 6M, and 6C storing unused toners of different colors. For this reason, the configuration of one process unit 1K will be described below, and the description of the other process units 1Y, 1M, and 1C will be omitted.

The process unit 1K includes an image bearer 2K (element 2 in FIG. 1B) (for example, a photoconductor drum), a drum cleaning device 3K (element 3 including cleaning blade 3*a* in FIG. 1B), and a static eliminator. The process unit 1K further includes a charging device 4K (element 4 in FIG. 1B) as a charger for uniformly charging the surface of the image bearer, and a developing device 5K (element 5 including developing roller 5*a* in FIG. 1B) as a developing unit for performing visible image processing of an electrostatic latent image formed on the image bearer. The process unit 1K is detachably mounted in the main body of the image forming apparatus 100, and consumable parts can be replaced at the same time.

An exposure device 7 is disposed above the process units 1K, 1Y, 1M, and 1C installed in the image forming apparatus 100. The exposure device 7 performs the writing scan corresponding to image information, that is, reflects a laser beam Lb from a laser diode with a mirror 7*a* and irradiates the image bearer 2K with the laser beam Lb based on image data.

In the present embodiment, a transfer device 15 is disposed below the process units 1K, 1Y, 1M, and 1C. This transfer device 15 corresponds to a transfer unit TM of FIG. 1B. Primary transfer rollers 19K, 19Y, 19M, and 19C are disposed in contact with an intermediate transfer belt 16 to face image bearers 2K, 2Y, 2M, and 2C.

The intermediate transfer belt 16 circulates while being stretched over the primary transfer rollers 19K, 19Y, 19M, and 19C, a drive roller 18, and a driven roller 17. A secondary transfer roller 20 is disposed facing the drive roller 18 and being in contact with the intermediate transfer belt 16. Assuming that the image bearers 2K, 2Y, 2M, and 2C are first image bearers of the respective colors, the intermediate transfer belt 16 is a second image bearer that combines these images.

A belt cleaning device 21 is installed on the downstream side of the secondary transfer roller 20 in the running direction of the intermediate transfer belt 16. A cleaning backup roller is installed on the opposite side of the belt cleaning device 21 with respect to the intermediate transfer belt 16.

A sheet feeding device 200 having a tray on which sheets P are stacked is installed below the image forming apparatus 100. The sheet feeding device 200 constitutes a recording medium supply unit and can store a large number of sheets P as recording media in a bundle. The sheet feeding device 200 is used together with a sheet feed roller 60 and a roller pair 210 as conveyance unit for the sheet P.

The sheet feeding device 200 can be inserted into and removed from the main body of the image forming apparatus 100 in order to replenish sheets. The sheet feed roller 60 and the roller pair 210 are disposed above the sheet feeding device 200 so as to convey the uppermost sheet P of the sheet feeding device 200 toward a sheet feed path 32.

A registration roller pair 250 as a separation and conveyance unit is disposed immediately upstream in the conveying direction of the secondary transfer roller 20 and can temporarily stop the sheet P fed from the sheet feeding device 200. By this temporary stop, slack is formed on the leading-edge side of the sheet P, and the skew of the sheet P is corrected.

A registration sensor 31 is disposed immediately upstream in the conveyance direction of the registration roller pair 250, and the registration sensor 31 detects the passage of the leading edge of the sheet. When a predetermined time elapses after the registration sensor 31 detects the passage of the leading edge of the sheet, the sheet is abutted against the registration roller pair 250 and stops temporarily.

At the downstream end of the sheet feeding device 200, a conveyance roller 240 is disposed to convey the sheet, conveyed rightward from the roller pair 210, upward. As illustrated in FIG. 1A, the conveyance roller 240 conveys the sheet toward the upper registration roller pair 250.

The roller pair 210 is made up of a pair of upper and lower rollers. The roller pair 210 can be a feed reverse roller (FRR) separation method or a friction roller (FR) separation method. In the FRR separation method, a separation roller (return roller), to which a constant amount of torque is applied in the counter-sheet feeding direction via a torque limiter by a drive shaft, is pressed against a sheet feed roller to separate the sheet at the nip between the rollers. In the FR separation method, a separation roller (friction roller) supported by a fixed shaft via a torque limiter is pressed against a sheet feed roller to separate the sheet at the nip between the rollers.

In the present embodiment, the roller pair 210 is configured by the FRR separation method. That is, the roller pair 210 includes an upper sheet feed roller 220 that conveys the sheet into the machine, and a lower separation roller 230 that is given a driving force by a drive shaft via a torque limiter in the opposite direction to the sheet feed roller 220.

The separation roller 230 is energized toward the sheet feed roller 220 by an energization unit such as a spring. The sheet feed roller 60 transmits the driving force of the sheet feed roller 220 via a clutch unit to rotate counterclockwise in FIG. 1A.

The sheet P, abutted against the registration roller pair 250 and having a slack at the leading edge, is fed to a secondary transfer nip between the secondary transfer roller 20 and the drive roller 18 (transfer nip N in FIG. 1B), at the same timing as suitable transferring of a toner image formed on the intermediate transfer belt 16. On the fed sheet P, a toner image formed on the intermediate transfer belt 16 is electrostatically transferred to the desired transfer position with high accuracy by the bias applied at a secondary transfer nip.

A post-transfer conveyance path 33 is disposed above the secondary transfer nip between the secondary transfer roller 20 and the drive roller 18. The fixing device 300 is installed near the upper end of the post-transfer conveyance path 33. The fixing device 300 includes a fixing belt 310 and a pressing roller 320 as a pressure member that rotates while being in contact with the fixing belt 310 with a predetermined pressure. The heating device is disposed inside a loop formed by the fixing belt 310. The fixing device 300 may have other configurations as illustrated in FIGS. 2B to 2D described later.

A post-fixing conveyance path 35 is disposed above the fixing device 300 and branches into a sheet ejection path 36 and a reverse conveyance path 41 at the upper end of the post-fixing conveyance path 35. A switcher 42 is disposed at this branching portion, and the switcher 42 swings about a pivot shaft 42*a*. A sheet ejection roller pair 37 is disposed in the vicinity of the opening end of the sheet ejection path 36.

The reverse conveyance path 41 joins the sheet feed path 32 at the other end opposite to the branching portion. In the middle of the reverse conveyance path 41, a reverse conveyance roller pair 43 is disposed A sheet ejection tray 44 is installed on the upper part of the image forming apparatus 100 so as to form a concave shape inward of the image forming apparatus 100.

A powder container 10 (for example, toner container) is disposed between the transfer device 15 and the sheet feeding device 200. The powder container 10 is detachably mounted on the main body of the image forming apparatus 100.

The image forming apparatus 100 according to the present embodiment requires a predetermined distance from the sheet feed roller 60 to the secondary transfer roller 20 due to transfer paper conveyance. The powder container 10 is installed in the dead space generated at this distance to reduce the size of the entire laser printer.

A transfer cover 8 is disposed at the top of the sheet feeding device 200 and in front of the sheet feeding device 200 in the drawing direction.

By opening the transfer cover 8, the inside of the image forming apparatus 100 can be checked.

The transfer cover 8 includes a manual sheet feed roller 45 for manual sheet feeding and a bypass tray 46 for manual sheet feeding.

Operation of Laser Printer

Next, the basic operation of the laser printer according to the present embodiment will be described below with reference to FIG. 1A. First, the case of performing single-sided printing will be described.

As illustrated in FIG. 1A, the sheet feed roller 60 is rotated by a sheet feed signal from the controller of the image forming apparatus 100. Then, the sheet feed roller 60 separates only the uppermost paper of a bundle of sheets P stacked on the sheet feeding device 200 and feeds the separated sheet to the sheet feed path 32.

When the leading edge of the sheet P fed by the sheet feed roller 60 and the roller pair 210 reaches the nip of the registration roller pair 250, the sheet P forms a slack thereon and waits in that state. Then, the optimum timing (synchronization) for transferring a toner image formed on the intermediate transfer belt 16 to the sheet P is achieved, and the leading-edge skew of the sheet P is corrected.

In the case of manual sheet feeding, a bundle of sheets stacked on the bypass tray 46 passes through a part of the reverse conveyance path 41 with the manual sheet feed roller 45, one by one from the uppermost sheet, and is conveyed to the nip between the registration roller pair 250. Subsequent operations are the same as the sheet feeding from the sheet feeding device 200.

Here, regarding the image forming operation, one process unit 1K will be described, and the description of the other process units 1Y, 1M, and 1C will be omitted. First, the charging device 4K uniformly charges the surface of the image bearer 2K to a high potential. Then, the exposure device 7 irradiates the surface of the image bearer 2K with the laser beam Lb based on image data.

On the surface of the image bearer 2K irradiated with the laser beam Lb, the potential of the irradiated portion is lowered to form an electrostatic latent image. The developing device 5K has a developer carrier that carries a developer containing toner and transfers unused black toner, supplied from the toner bottle 6K, to the surface portion of the image bearer 2K having the electrostatic latent image via the developer carrier.

The image bearer 2K to which the toner has been transferred forms (develops) a black toner image on the surface thereof. Then, the toner image formed on the image bearer 2K is transferred to the intermediate transfer belt 16.

The drum cleaning device 3K removes residual toner adhering to the surface of the image bearer 2K after the intermediate transfer process. The removed residual toner is sent and collected by a waste toner conveyance unit to a waste toner storage in the process unit 1K. Further, the static eliminator neutralizes the residual charge of the image bearer 2K from which the residual toner has been removed by the cleaning device 3K.

In the process units 1Y, 1M, and 1C for the respective colors, toner images are similarly formed on the image bearers 2Y, 2M, and 2C, and transferred to the intermediate transfer belt 16 so that the respective color toner images are overlapped. The intermediate transfer belt 16, to which the toner images of the respective colors have been transferred so as to overlap each other, runs to the secondary transfer nip between the secondary transfer roller 20 and the drive roller 18.

On the other hand, the registration roller pair 250 sandwiches the sheet abutted thereon and rotates at a predetermined timing, and conveys the sheet to the secondary transfer nip of the secondary transfer roller 20, at the same timing as suitable transferring of a toner image formed by superimposing and transferring on the intermediate transfer belt 16. In this way, the toner image on the intermediate transfer belt 16 is transferred to the sheet P fed by the registration roller pair 250.

The sheet P to which the toner image has been transferred is conveyed to the fixing device 300 through the post-transfer conveyance path 33. The sheet P conveyed to the fixing device 300 is sandwiched between the fixing belt 310 and the pressing roller 320, and the unfixed toner image is fixed onto the sheet P by heating and pressing. The sheet P on which the toner image has been fixed is fed from the fixing device 300 to the post-fixing conveyance path 35.

The switcher 42 is in a position where the vicinity of the upper end of the post-fixing conveyance path 35 is opened as indicated by a solid line in FIG. 1A at the timing when the sheet P is fed from the fixing device 300. The sheet P fed from the fixing device 300 is then fed to the sheet ejection path 36 via the post-fixing conveyance path 35. The sheet ejection roller pair 37 sandwiches the sheet P fed to the sheet ejection path 36, rotates, and discharges the sheet P to the sheet ejection tray 44, thereby completing single-sided printing.

Next, a case where duplex printing is performed will be described. As in the case of the single-sided printing, the fixing device 300 feeds the sheet P to the sheet ejection path 36. In the case where the duplex printing is performed, the sheet ejection roller pair 37 conveys a part of the sheet P to the outside of the image forming apparatus 100 by rotary driving.

When the rear end of the sheet P passes through the sheet ejection path 36, the switcher 42 swings about the pivot shaft 42*a* as indicated by a dotted line in FIG. 1A, and closes the upper end of the post-fixing conveyance path 35. Almost simultaneously with the closing of the upper end of the post-fixing conveyance path 35, the sheet ejection roller pair 37 rotates in a direction opposite to the direction in which the sheet P is conveyed out of the image forming apparatus 100, and feeds the sheet P to the reverse conveyance path 41.

The sheet P fed to the reverse conveyance path 41 reaches the registration roller pair 250 through the reverse conveyance roller pair 43. Then, the registration roller pair 250 achieves the optimum timing (synchronization) for transferring the toner image formed on the intermediate transfer belt 16 to the toner image untransferred surface of the sheet P, and feeds the sheet P to the secondary transfer nip.

The secondary transfer roller 20 and the drive roller 18 transfer the toner image to the toner image untransferred surface (back surface) of the sheet P when the sheet P passes through the secondary transfer nip. Then, the sheet P onto which the toner image is transferred is conveyed to the fixing device 300 through the post-transfer conveyance path 33.

In the fixing device 300, the conveyed sheet P is sandwiched between the fixing belt 310 and the pressing roller 320 to be fixed and pressed so that the unfixed toner image is fixed onto the back surface of the sheet P. In this way, the sheet P with the toner images fixed onto both the front and back sides is fed from the fixing device 300 to the post-fixing conveyance path 35.

The switcher 42 is in a position where the vicinity of the upper end of the post-fixing conveyance path 35 is opened as indicated by a solid line in FIG. 1A at the timing when the sheet P is fed from the fixing device 300. The sheet P fed from the fixing device 300 is fed to the sheet ejection path 36 via the fixing conveyance path. The sheet ejection roller pair 37 sandwiches the sheet P fed to the sheet ejection path 36, rotates, and discharges the sheet to the sheet ejection tray 44, thereby completing duplex printing.

After the toner image on the intermediate transfer belt 16 is transferred to the sheet P, residual toner adheres on the intermediate transfer belt 16. The belt cleaning device 21 removes this residual toner from the intermediate transfer belt 16. Further, the toner removed from the intermediate transfer belt 16 is conveyed to the powder container 10 by the waste toner conveyance unit and collected in the powder container 10.

Fixing Device

Next, the heating device and the fixing device 300 according to an embodiment of the present disclosure will be further described below. The heating device of the present embodiment heats the fixing belt 310 of the fixing device 300.

The fixing device 300 can employ various fixing devices. Here, only five types of fixing devices 300 illustrated in FIGS. 2A to 2E are illustrated, but embodiments of the present disclosure are not limited to such fixing devices.

Figure 2A:
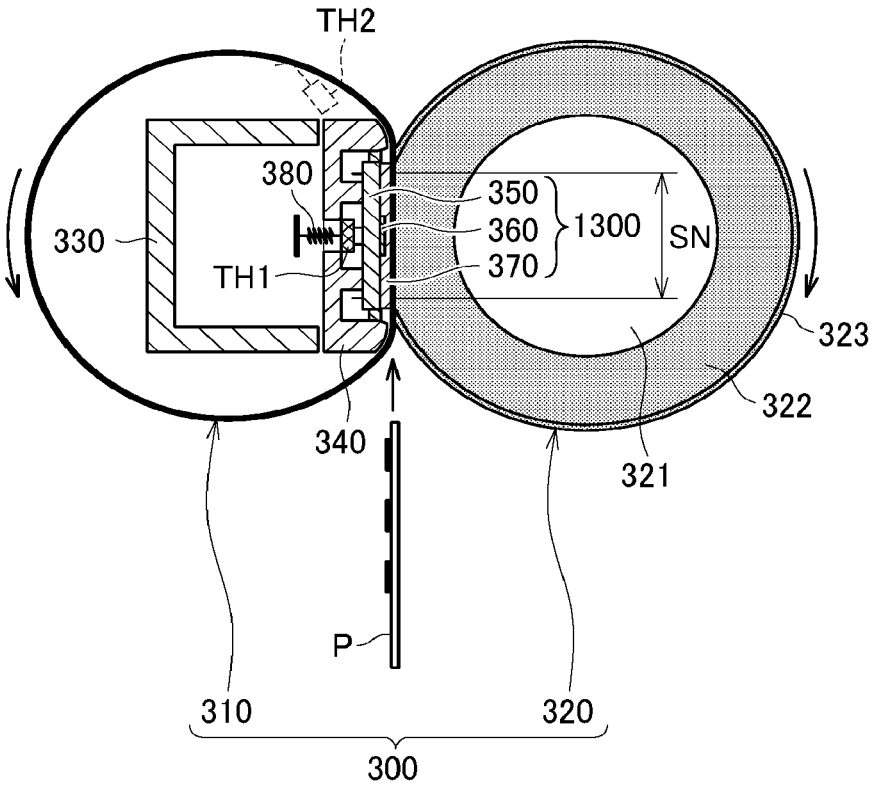
FIG. 2A is a cross-sectional view of a first fixing device according to an embodiment of the present disclosure.
Figure 2B:
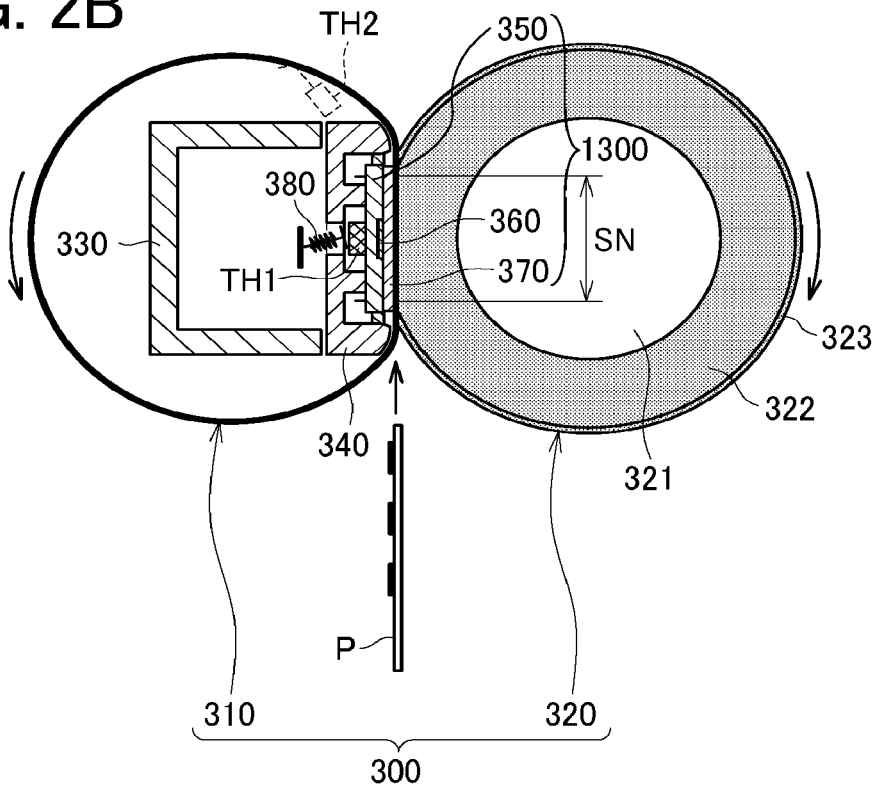
FIG. 2B is a cross-sectional view of a second fixing device according to an embodiment of the present disclosure.
Figure 2C:
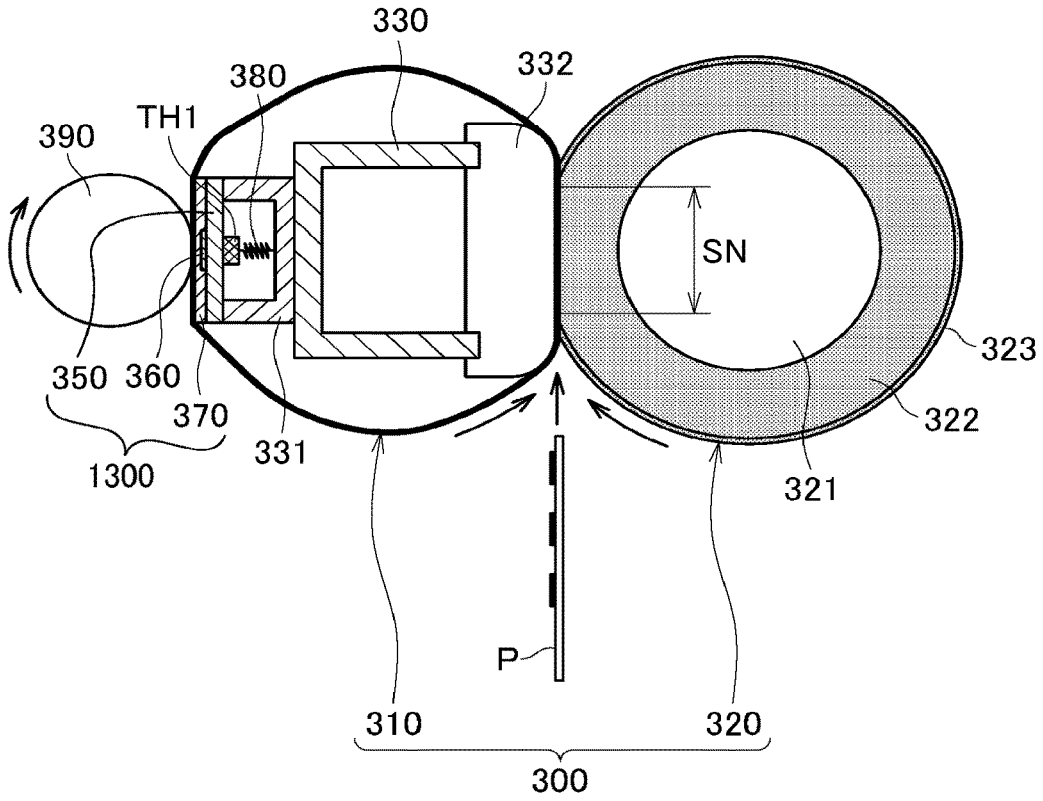
FIG. 2C is a cross-sectional view of a third fixing device according to an embodiment of the present disclosure.
Figure 2D:
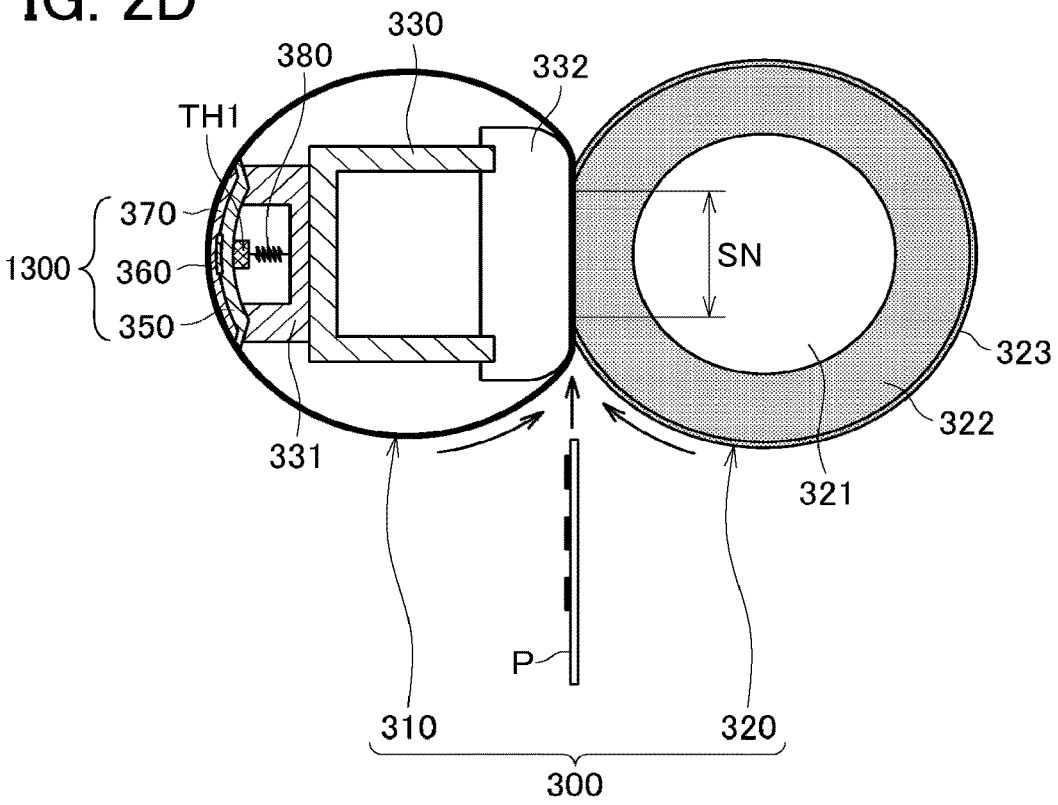
FIG. 2D is a cross-sectional view of a fourth fixing device according to an embodiment of the present disclosure.

As illustrated in FIG. 2A, the first fixing device 300 includes the thin fixing belt 310 having a low heat capacity and the pressing roller 320. The fixing belt 310 includes, for example, a cylindrical substrate made of polyimide (P1) having an outer diameter of 25 mm and a thickness of 40 to 120 μm.

On the outermost layer of the fixing belt 310, a release layer having a thickness of 5 to 50 μm is formed with a fluorine-based resin such as perfluoroalkoxy alkanes (PFA) or polytetrafluoroethylene (PTFE) in order to enhance durability and ensure release properties. An elastic layer made of rubber or the like having a thickness of 50 to 500 μm may be provided between the substrate and the release layer.

The substrate of the fixing belt 310 is not limited to polyimide but may be a heat-resistant resin such as polyetheretherketone (PEEK) or a metal substrate such as nickel (Ni) or steel-use stainless (SUS). The inner peripheral surface of the fixing belt 310 may be coated with polyimide or PTFE as a sliding layer.

The pressing roller 320 has an outer diameter of, for example, 25 mm and is made up of a solid iron metal core 321, an elastic layer 322 formed on the surface of the metal core 321, and a release layer 323 formed outside the elastic layer 322. The elastic layer 322 is formed of silicone rubber and has a thickness of, for example, 3.5 mm.

It is desirable to form the release layer 323 made of a fluororesin layer having a thickness of, for example, about 40 μm on the surface of the elastic layer 322 in order to improve the release properties. A pressing roller 320 is pressed against the fixing belt 310 by an energization unit.

Inside the fixing belt 310, a stay 330 and a holder 340 are disposed in the axial direction. The stay 330 is made of a metal channel material, and both end portions thereof are supported by both side plates of the heating device. The stay 330 reliably receives the pressing force of the pressing roller 320 and stably forms a fixing nip SN. The heating device includes a heater 1300. The heater 1300 includes a base 350, a resistive heat generator 360, and a protection layer 370.

The holder 340 holds the base 350 of the heater 1300 and is supported by the stay 330. The holder 340 can be preferably formed of a heat-resistant resin having low thermal conductivity such as liquid-crystal polymer (LCP), whereby heat transfer to the holder 340 is reduced and the fixing belt 310 can be heated efficiently.

The holder 340 is formed in a shape to support only two locations near both end portions in the short direction of the base 350 in order to avoid contact with a high-temperature portion of the base 350. As a result, the amount of heat flowing to the holder 340 can further be reduced and the fixing belt 310 can be heated efficiently. However, when it is desired to suppress the temperature increase of the surface of the heating device opposite to the sliding surface of the fixing belt 310, the amount of heat flowing to the holder 340 may be increased by bringing the base 350 into contact with the holder 340.

Other Fixing Devices

Next, the second to fifth fixing devices 300 are described with reference to FIGS. 2B to 2E. In the second fixing device 300, as illustrated in FIG. 2B, the resistive heat generator 360 is accommodated in a groove extending in the longitudinal direction of the base 350. The other configurations of the second fixing device 300 are the same as those of the first fixing device 300 in FIG. 2A. By housing the resistive heat generator 360 in the groove, it is possible to prevent the resistive heat generator 360 from being damaged and to improve the detection accuracy of a temperature sensor TH1 disposed on the back-surface side of the base 350.

As illustrated in FIG. 2C, the third fixing device 300 includes a press roller 390 on the opposite side of the pressing roller 320 and heats the fixing belt 310 between the press roller 390 and the heating device. The heating device described above is disposed inside the loop formed by the fixing belt 310.

An auxiliary stay 331 is attached to one side of the stay 330, and a nip formation pad 332 is attached to the opposite side. The heating device is held by the auxiliary stay 331. The nip formation pad 332 is in contact with the pressing roller 320 via the fixing belt 310 to form the fixing nip SN.

In the fourth fixing device 300, as illustrated in FIG. 2D, the heating device is disposed inside the loop formed by the fixing belt 310. In the heating device, in order to increase the circumferential contact length with the fixing belt 310 instead of omitting the press roller 390 described above, the cross-section of each of the base 350 and a protection layer 370 is formed in an arc shape in accordance with the curvature of the fixing belt 310. The resistive heat generator 360 is disposed at the center of the arc-shaped base 350. The other configurations are the same as those of the third fixing device 300 in FIG. 2C.

Figure 2E:
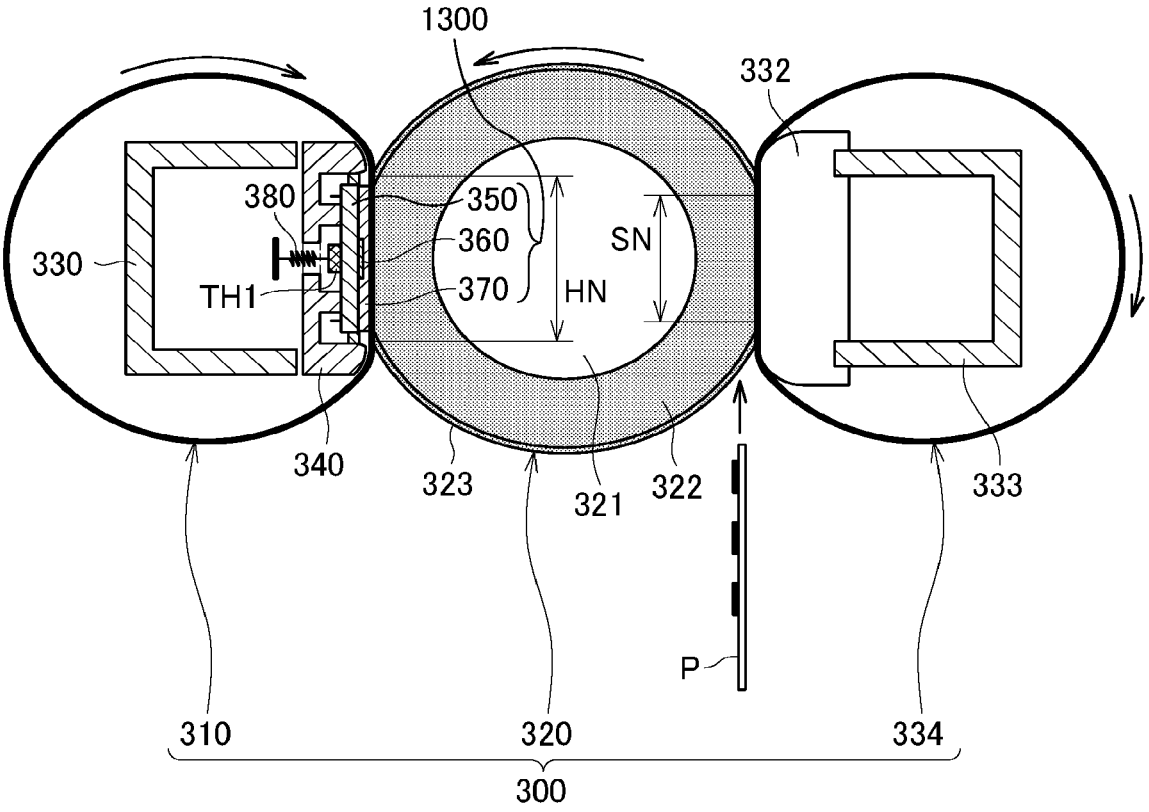
FIG. 2E is a cross-sectional view of a fifth fixing device according to an embodiment of the present disclosure.

As illustrated in FIG. 2E, the fifth fixing device 300 is divided into a heating nip HN and the fixing nip SN. That is, the nip formation pad 332 and a stay 333 made of a metal channel material are disposed on the opposite side of the pressing roller 320 from the fixing belt 310, and a pressing belt 334 is turnably disposed so as to include the nip formation pad 332 and the stay 333. Then, the sheet P is allowed to pass through the fixing nip SN between the pressing belt 334 and the pressing roller 320 to be heated and fixed. The other configurations are the same as those of the first fixing device 300 in FIG. 2A.

Further, a second temperature sensor TH2 for safety compensation may be disposed as indicated by a broken line in FIG. 2A. That is, the second temperature sensor TH2 is disposed on the inner peripheral surface of the fixing belt 310 (the downstream inner peripheral surface of a heat generation pattern 366), which is heated by the heat generation pattern 366 different from a heat generation pattern 364 detected by the first temperature sensor TH1 for temperature control, so as to be pressure-bonded by the energization unit.

Increasing the number of heat generation patterns makes it difficult to ensure the space for disposing the temperature sensor. However, disposing the second temperature sensor TH2 as described above can reduce the difficulty of ensuring the space. The second temperature sensor TH2 for safety compensation may be disposed not only for the heat generation pattern 366 but also for each of heating regions of the other heat generation patterns 361 to 363 and 365 including the inner peripheral surface of the fixing belt 310.

Heating Device

Figure 3A:
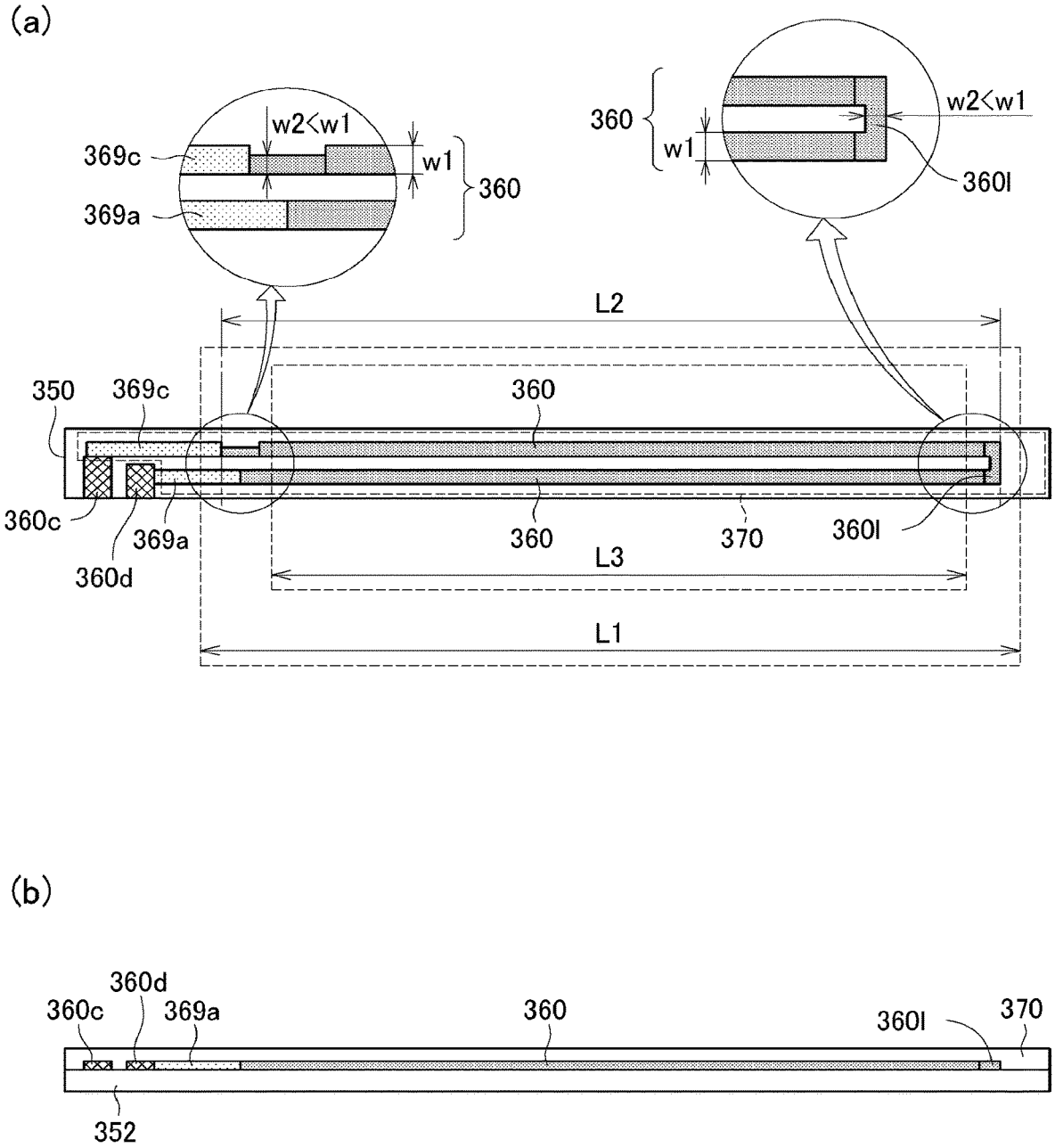
FIG. 3A is a diagram including (a) a plan view and (b) a cross-sectional view of a resistive heat generator having narrow portions at both ends.
Figure 3B:
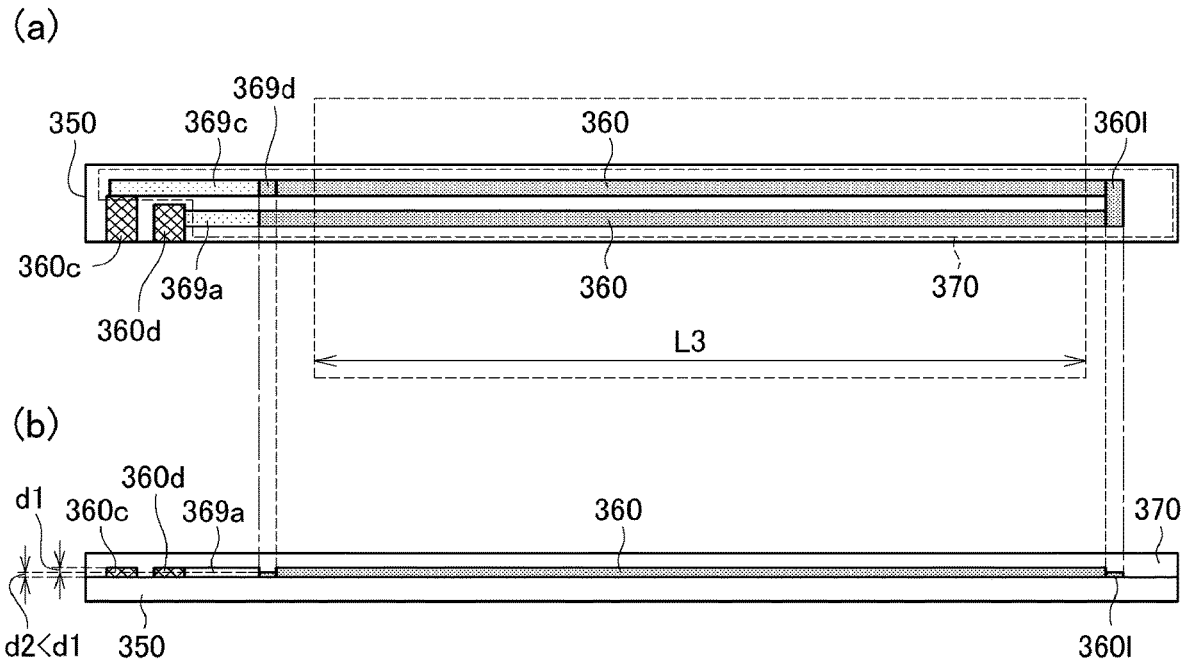
FIG. 3B is a diagram including (a) a plan view and (b) a cross-sectional view of a resistive heat generator having thin portions at both ends.
Figure 3C:
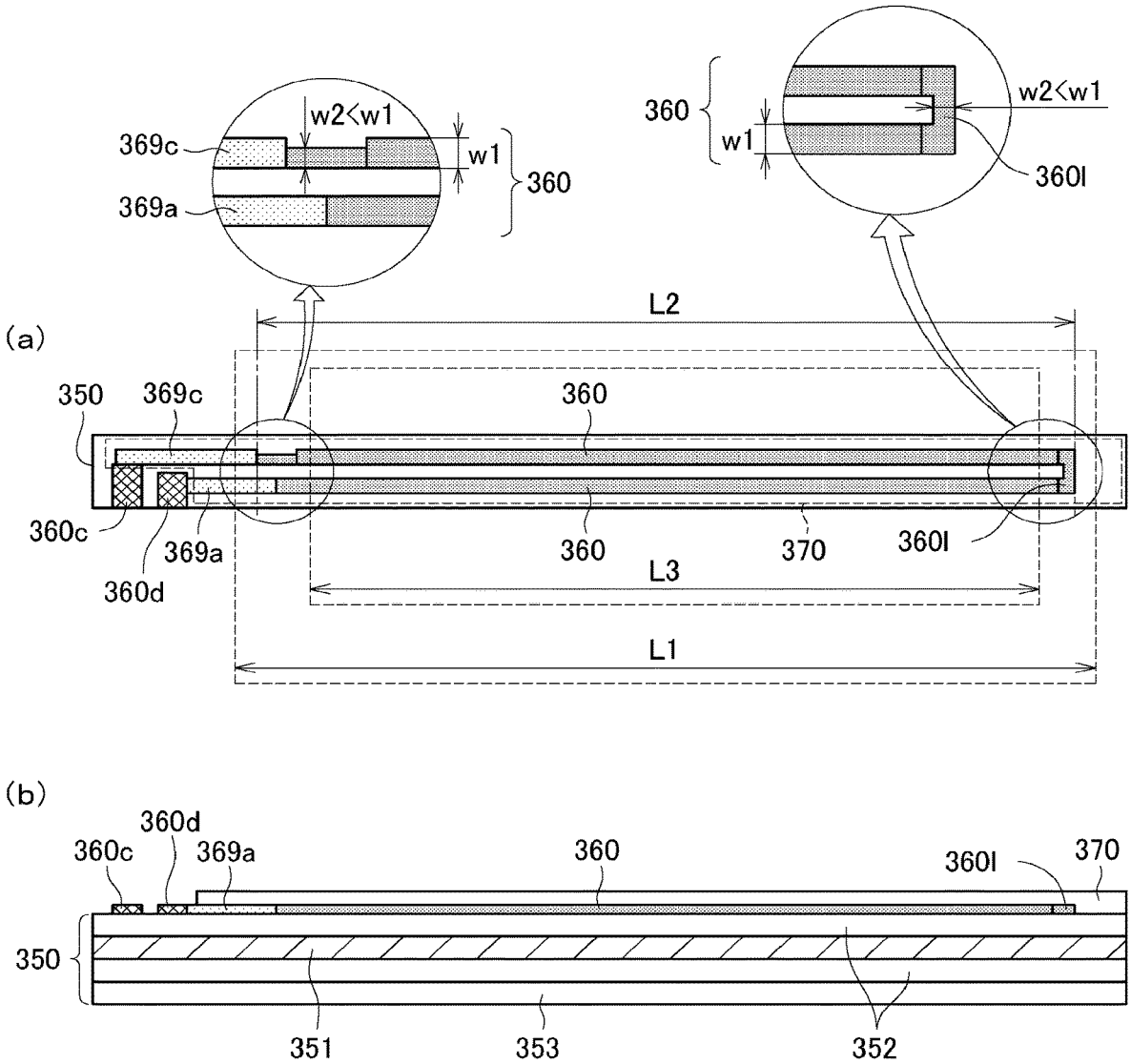
FIG. 3C is a diagram including (a) a plan view and (b) cross-sectional view of a resistive heat generator having narrow portions at both ends.
Figure 3D:
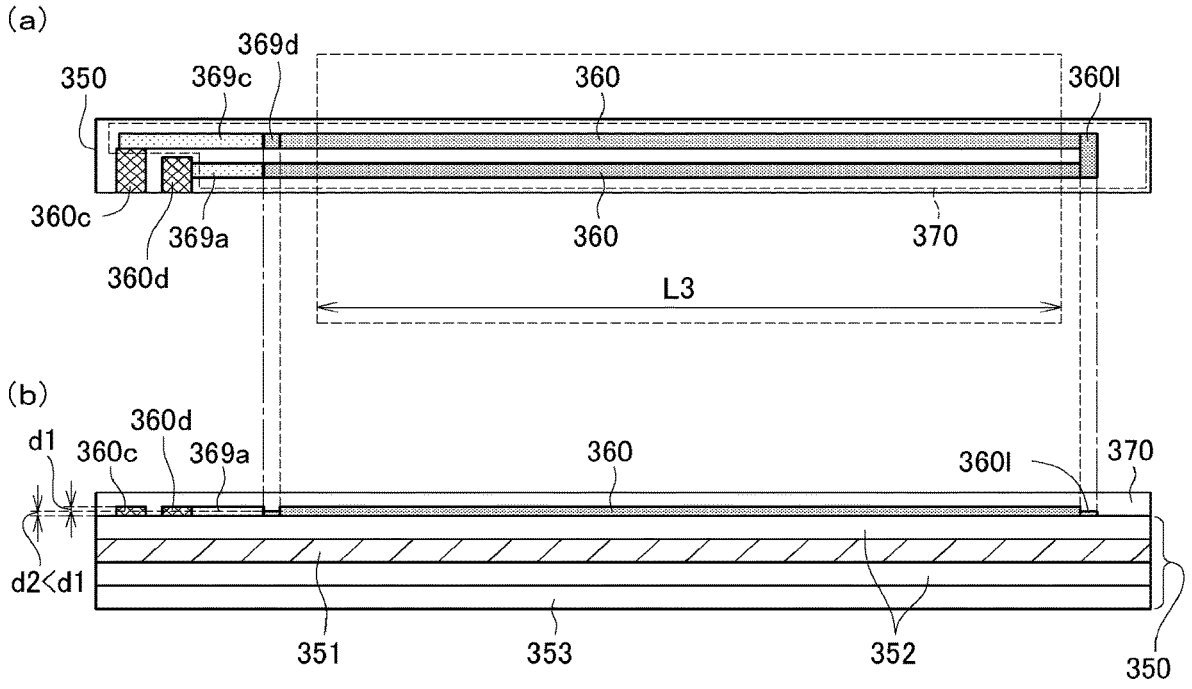
FIG. 3D is a diagram including (a) a plan view and (b) cross-sectional view of a resistive heat generator having thin portions at both ends.

Next, details of the heating device will be described with reference to FIGS. 3A to 4D. FIGS. 3A and 3B illustrate resistive heat generators 360 extending in the longitudinal direction of the base formed in two parallel rows. FIGS. 3C and 3D are also resistive heat generators 360 formed in two parallel rows in the same manner, but the strength is increased by using metal material for a substrate 351.

Figure 4A:
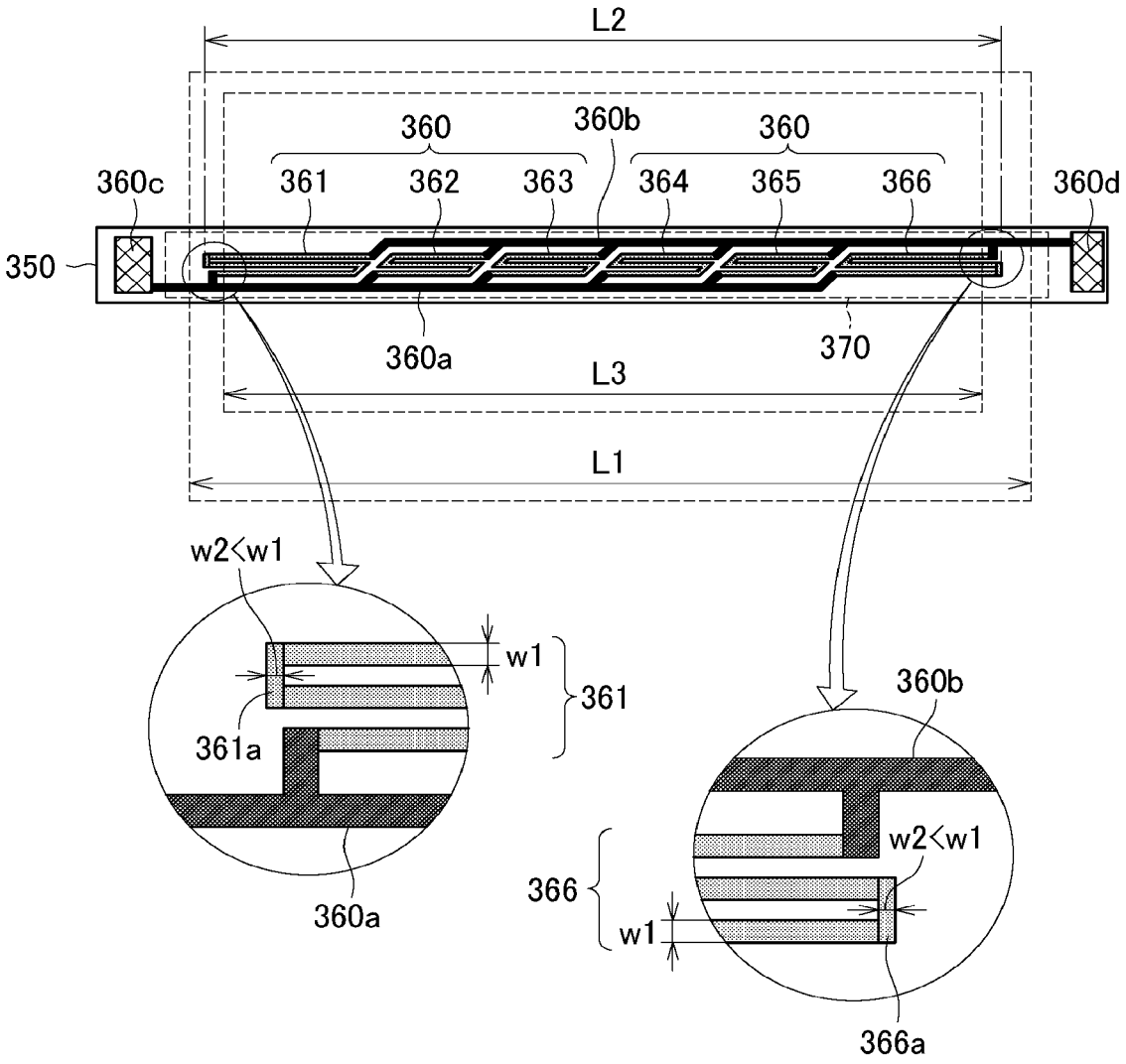
FIG. 4A is a plan view of a resistive heat generator having narrow portions at both ends.
Figure 4B:
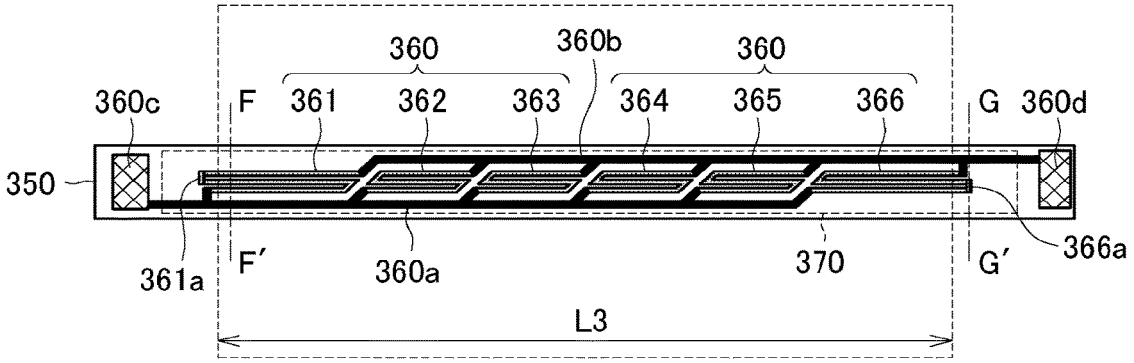
FIG. 4B is a diagram including (a) a plan view, (b) an FF' line cross-sectional view, and (c) a GG' line cross-sectional view of a resistive heat generator having thin portions at both ends.
Figure 4B:
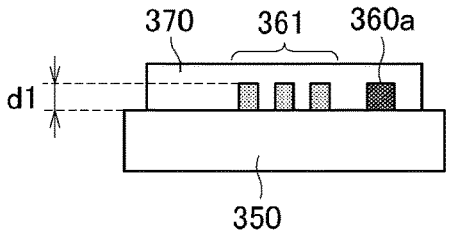
Figure 4B:
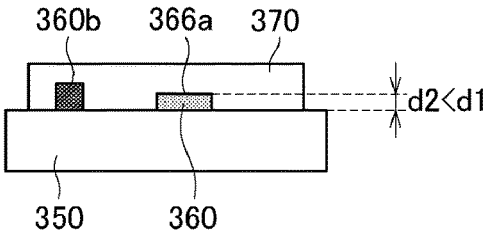
Figure 4C:
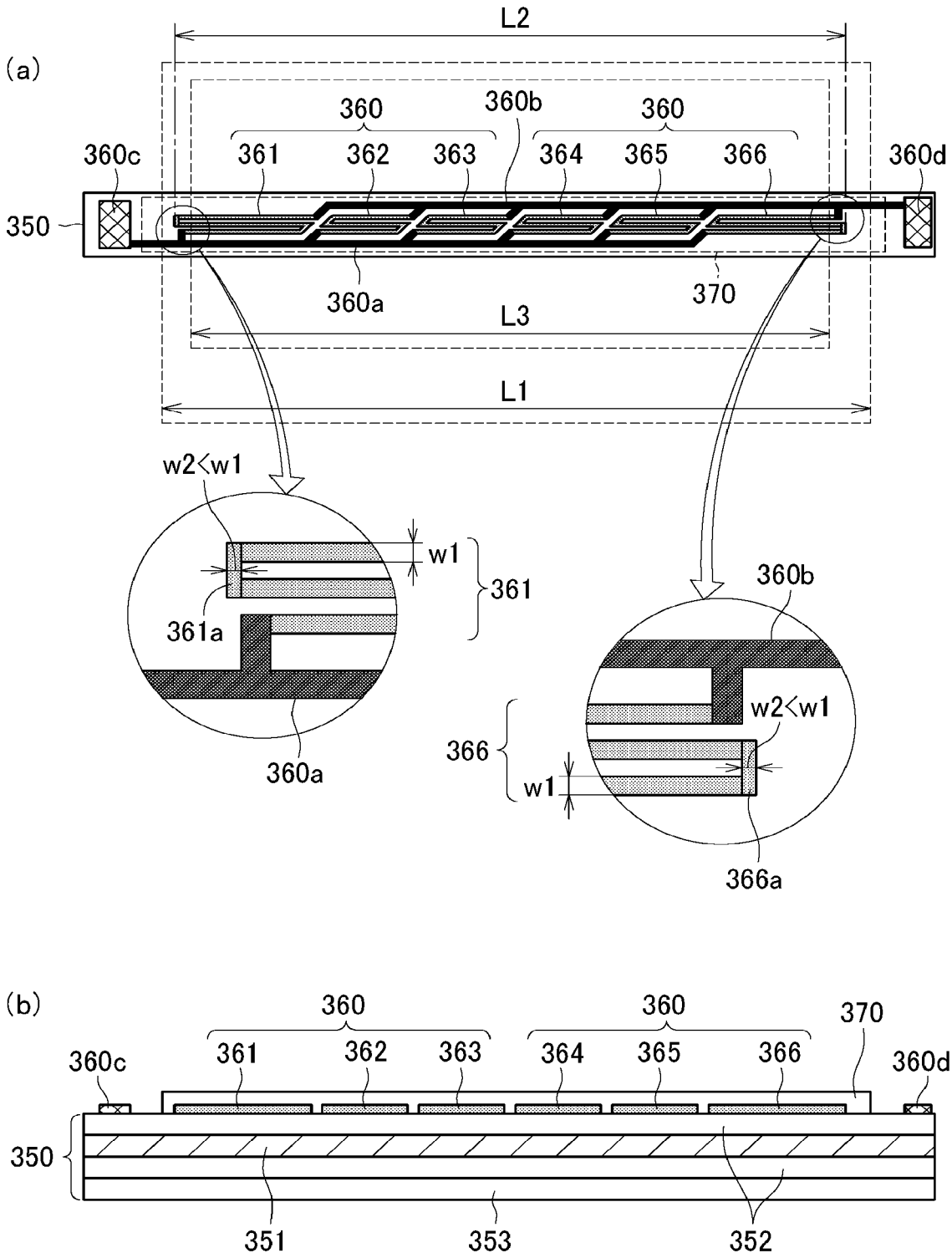
FIG. 4C is a diagram including (a) a plan view and (b) a cross-sectional view of a resistive heat generator having narrow portions at both ends.
Figure 4D:
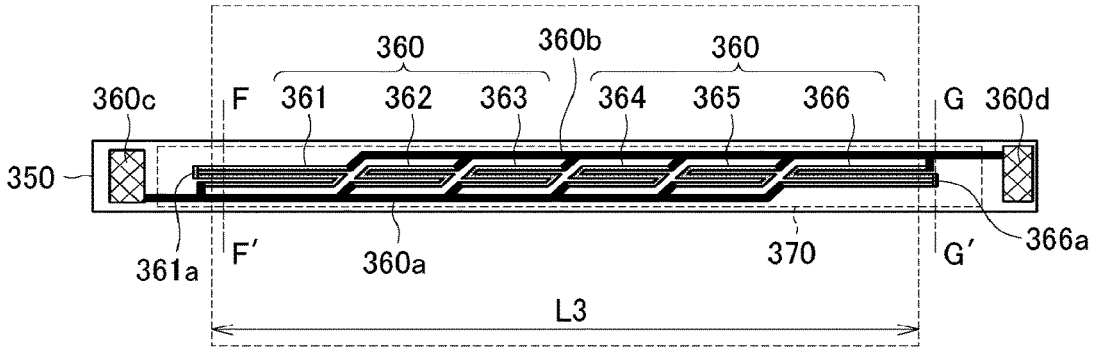
FIG. 4D is a diagram including (a) a plan view, (b) an FF' line cross-sectional view, and (c) a GG' line cross-sectional view of a resistive heat generator having thin portions at both ends.
Figure 4D:
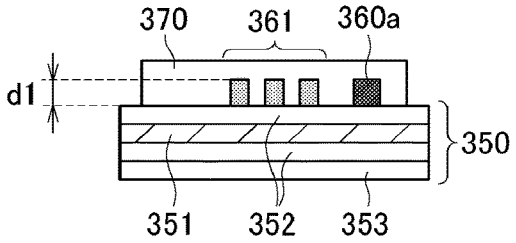
Figure 4D:
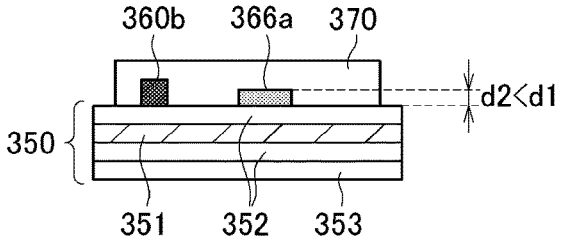

FIGS. 4A and 4B illustrate a plurality of heat generation patterns 361 to 366 as resistive heat generators 360 arranged on the base 350 and connected in parallel. FIGS. 4C and 4D illustrate a plurality of heat generation patterns 361 to 366 connected in parallel in the same manner, but the strength is increased by using metal material for the substrate 351.

Series Resistive Heat Generator

The resistive heat generator 360 of FIG. 3A is formed on the elongated base 350 in a series form. As the material of the base 350, low-cost aluminum, stainless steel, or the like is preferred other than general ceramics. High thermal conductivity materials such as copper, graphite, and graphene are more preferred because the image quality can be improved by making the temperature of the entire heater uniform by the effect of thermal conduction.

In the present embodiment, an alumina base is used. The outer shape of the base 350 can be, for example, a short width of 8 mm, a long width of 270 mm, and a thickness of 1.0 mm. The thickness is more preferably 0.2 to 0.5 mm than 1.0 mm for lightening.

Specifically, the resistive heat generator 360 of FIG. 3A is configured by resistance lines formed in a series line shape in two parallel rows in the longitudinal direction of the base 350. One end portion of each of the two rows of resistance lines or the resistive heat generators 360 is connected to each of feeding electrodes 360*c* and 360*d* via the power supply lines 369*a* and 369*c* with small resistance values, formed in the longitudinal direction on one end portion side of the base 350. The electrodes 360*c* and 360*d* are connected to an electric power supply unit including an alternating current (AC) power source 410, which will be described later in FIGS. 8A to 8D.

The other end portion of the resistance line in one row of the resistive heat generator 360 is connected to the other end portion of the resistance line in the other row in a folding form toward the opposite side in the longitudinal direction of the base 350 via a folded portion 360*l* formed in the short side direction on the other end portion side of the base 350. The folded portion 360*l* is made of the same material as the resistive heat generator 360, has the same thickness as the resistive heat generator 360, and is formed by screen printing together with the electrodes 360*c* and 360*d* and the power supply lines 369*a* to 369*c*.

A narrow portion w2 that is approximately half a line width w1 of the resistive heat generator 360 is formed in the folded portion 360*l*. The narrow portion w2 forms an interrupting portion that reliably interrupts the power supply due to overheating in the event of an abnormality.

The narrow portion w2 is formed to narrow in the direction perpendicular to the direction in which current flows. The narrow portion w2 can be formed to have a line width of 60 μm or less, for example. When the temperature of the folded portion 360*l* increases abnormally, the narrow portion w2 is easily disconnected when having a line width of 60 μm or less, and is hardly disconnected when having a line width of 70 μm or more.

The line width w1 of the resistive heat generator 360 and the line thickness of the narrow portion w2 are formed with the same thickness. The narrow portion w2 may be formed in any portion so long as being within the region of the folded portion 360*l*.

A similar narrow portion w2 is also formed at the end portion of the resistive heat generator 360 connected to the power supply line 369*c*. The narrow portion w2 may be formed at the end portion of the resistive heat generator 360 connected to the power supply line 369*a*.

The material of the resistive heat generator 360 can be formed by applying a paste prepared by mixing silver (Ag) or silver palladium (AgPd), glass powder, or the like by screen printing or the like, and then baking. The resistance value of the resistive heat generator 360 can be set to 10Ω at room temperature, for example.

In addition to the resistance material of the resistive heat generator 360, silver alloy (AgPt), ruthenium oxide (RuO2), or the like can also be used. Since the resistive heat generator 360 can be formed by a single screen printing, there is no need to deal with the complicated manufacturing process due to an increase in number of firings or masking, the uniform thickness of the film using different materials, and the like. It is thus possible to constitute the resistive heat generator 360 at low cost.

The surfaces of the resistive heat generator 360 and the power supply lines 369*a* to 369*c* are covered with an insulating thin overcoat layer or protection layer 370. In the present embodiment, the protection layer 370 is formed of heat-resistant glass having a thickness of 75 μm. The protection layer 370 ensures the sliding of the fixing belt 310 and ensures the insulation between the fixing belt 310, the resistive heat generator 360, and the power supply lines 369*a* to 369*c*.

As a material of the protection layer 370, for example, heat resistant glass having a thickness of 75 μm can be used. The resistive heat generator 360 heats the fixing belt 310 in contact with the protection layer 370 side by heat transfer to raise its temperature, and heats and fixes an unfixed image on the sheet P conveyed to the fixing nip SN.

Since the power supply width of the resistive heat generator 360 is locally reduced by the narrow portion w2, the heat generation density in the narrow portion w2 increases even during the steady running of the fixing belt 310. Then, when the end portion of the fixing belt 310 is damaged due to some abnormality and the fixing belt 310 shifts toward one side in the width direction, the longitudinal end portion of the resistive heat generator 360 is exposed on the side opposite to the shifting.

When the longitudinal end portion of the resistive heat generator 360 is exposed, only that portion abnormally increases in temperature, and as a result, the increase in the resistance value of the narrow portion w2 or the interrupting portion is accelerated. Then, when the temperature of the protection layer 370 covering the narrow portion w2 exceeds its melting point, the protection layer 370 melts. Then, the material component of the resistive heat generator 360 in the region centering on the narrow portion w2 and the glass component of the protection layer 370 are mixed to come into an insulating state, and the power supply is interrupted.

That is, the narrow portion w2 constitutes an interrupting portion that is reliably disconnected due to overheating in the event of an abnormality. This ensures the safety of the heating device even when the fixing belt 310 is damaged due to some abnormality. Note that there is a possibility that, before the protection layer 370 melts, the internal stress of the base 350 may increase due to a local temperature increase in the narrow portion w2 or the interrupting portion, and damage and disconnection may occur due to stress concentration of the base 350, thereby interrupting the power supply. Further, simultaneously with the melting and insulation of the protection layer 370 is, the base 350 may be damaged or disconnected due to the stress concentration.

Here, the "during steady running" of the fixing belt 310 includes both a case where the fixing belt 310 does not shift at all in the width direction and a case where the fixing belt 310 hardly shifts. "Hardly shifts" means that the end portion of the resistive heat generator 360 is not overheated by the movement of the fixing belt 310, and no substantial disadvantage occurs in the fixing operation to be described later. Further, "during the shifting of the fixing belt 310" refers to a case where the fixing belt 310 shifts toward one side in the width direction, and the end portion of the resistive heat generator 360 is overheated, or a fixing operation to be described below is hindered.

The resistive heat generator 360 in FIG. 3B is formed by forming a thin portion d2 in place of the narrow portion w2 in FIG. 3A at the folded portion 360*l* and the end portion of connection of the power supply lines in the resistive heat generator 360. The thin portion d2 can be formed with a thickness, for example, approximately half of the thickness d1 of the main body of the resistive heat generator 360. The other configurations are the same as those in FIG. 3A.

The resistive heat generator 360 in FIG. 3C uses metal material for the substrate 351. An insulation layer 352 is disposed on the front and back of the substrate 351, and the bottom surface and the front surface are covered with protection layers 353 and 370. As in FIG. 3A, the resistive heat generator 360 is formed by forming the narrow portion w2 at each of the folded portion 360*l* of the resistive heat generator 360 and the end portion of connection of the power supply lines in the resistive heat generator 360. The other configurations are the same as those in FIG. 3A.

The resistive heat generator 360 in FIG. 3D also uses metal material for the substrate 351. The insulation layer 352 is disposed on the front and back of the substrate 351, and the bottom surface and the front surface are covered with the protection layers 353 and 370. The thin portion d2 is formed at the folded portion 360*l* of the resistive heat generator 360 and the end portion of connection of the resistive heat generator 360 to the power supply line 369*c*. The thin portion d2 is the same as that described with reference to FIG. 3B, and can be formed with, for example, approximately half the thickness d1 of the main body of the resistive heat generator 360. The other configurations are the same as those in FIG. 3A.

As illustrated in FIGS. 3C and 3D, the resistive heat generator 360 using metal material for the substrate 351 is more resistant to thermal shock due to local temperature increase than that using a ceramic base. However, the resistive heat generator 360 may be short-circuited when the insulation layer 352 at the end portion of the resistive heat generator 360 melts at the time of abnormal temperature increase at the end portion.

Therefore, the glass of the protection layer 370 is made of a material having a lower melting point than that of the glass of the insulation layer 352. As a result, when the fixing belt 310 is damaged due to some abnormality and a local temperature increase occurs at the end portion of the resistive heat generator 360, the protection layer 370 melts before the insulation layer 352.

Due to the melting, the glass component of the protection layer 370 and the material component of the resistive heat generator 360 of the narrow portion w2 or the thin portion d2 are mixed, so that the interrupting portion of the narrow portion w2 or the thin portion d2 becomes insulative to interrupt the power supply. On the other hand, if the insulation layer 352 has a melting point equal to or lower than the melting point of the protection layer 370, the insulation cannot be ensured between the resistive heat generator 360 and the substrate 351 due to the melting of the insulation layer 352 at the time of the local temperature increase described above.

Parallel Resistive Heat Generator

The resistive heat generator 360 of FIG. 4A is a parallel type and is formed by arranging a plurality (six) of heat generation patterns 361 to 366 in the longitudinal direction of the base 350. The heat generation patterns 361 to 366 are connected in parallel by power supply lines 360*a* and 360*b*. The end portions of the power supply lines 360*a* and 360*b* are connected to the electrodes 360*c* and 360*d* disposed on both end portions of the base 350.

The electrodes 360*c* and 360*d* can be arranged on both ends of the heat generation patterns 361 to 366, or on one side of the heat generation patterns 361 to 366. Arranging the electrodes 360*c* and 360*d* on one side enables space-saving in the longitudinal direction.

The resistance line of each of the heat generation patterns 361 to 366 is formed with a narrow line width in a meandering manner in the short direction of the base 350. As illustrated in the partially enlarged view, the resistance lines of the heat generation patterns 361 and 366 formed at both ends are narrow portions w2 of about half the line widths w1 of the heat generation patterns 361 and 366 in the meandering folded portions 361*a* and 366*a*. The narrow portion w2 may be formed in any portion so long as being within the region of each of the folded portions 361*a* and 366*a*.

The heat generation patterns 361 to 366 and the power supply lines 360*a* and 360*b* are also covered with a thin protection layer 370 in the same manner as the series resistive heat generator 360 (FIGS. 3A to 3D) described above. The protection layer 370 can be made of heat resistant glass having a thickness of 75 μm, for example. The protection layer 370 insulates and protects the heat generation patterns 361 to 366 and the power supply lines 360*a* and 360*b* and maintains the sliding with the fixing belt 310.

The resistive heat generator 360 of FIG. 4B also has heat generation patterns 361 to 366 connected in parallel as in FIG. 4A. A thin portions d2 are formed in meandering folded portions 361*a* and 366*a* of the heat generation patterns 361 and 366 in place of the narrow portion w2 in FIG. 4A. The thin portion d2 can be formed with a thickness, for example, approximately half of the thickness d1 of the resistance line of each of the heat generation patterns 361 and 366, for example. The other configurations are the same as those in FIG. 4A.

The resistive heat generator 360 in FIG. 4C uses metal material for the substrate 351. The insulation layer 352 is disposed on the front and back of the substrate 351, and the bottom surface and the front surface are covered with the protection layers 353 and 370. The other configurations are the same as those in FIG. 4A. That is, as in FIG. 4A, narrow portions w2 of approximately half the line width of the heat generation patterns 361 and 366 are formed in the meandering folded portions 361*a* and 366*a* of the heat generation patterns 361 and 366 at both ends.

The resistive heat generator 360 of FIG. 4D also uses metal material for the substrate 351. The insulation layer 352 is disposed on the front and back of the substrate 351, and the bottom surface and the front surface are covered with the protection layers 353 and 370. The other configurations are the same as those in FIG. 4B. That is, as in FIG. 4B, the thin portions d2 are formed in the meandering folded portions 361*a* and 366*a* of the heat generation patterns 361 and 366.

Since FIGS. 4C and 4D also use metal material for the substrate 351, the glass of the protection layer 370 is made of a material having a melting point lower than that of the glass of the insulation layer 352 for the reasons described above. As a result, when the fixing belt 310 is damaged due to some abnormality and a local temperature increase occurs at the end portion of the resistive heat generator 360, the protection layer 370 melts before the insulation layer 352, and the narrow portion w2 or By mixing with the material of the resistive heat generator 360 of the thin portion d2, the narrow portion w2 or the interrupting portion of the thin portion d2 becomes insulative and the conduction is interrupted. That is, the thin portion d2 constitutes an interrupting portion that is reliably disconnected due to overheating at the time of abnormality.

Heat Generation Pattern by PTC Element

Each of the heat generation patterns 361 to 366 can be formed of positive temperature coefficient (PTC) elements. The PTC element is made of a material having a positive temperature coefficient of resistance (TCR) and has a feature that when a temperature T increases, the resistance value increases (current I decreases and the heater output decreases).

The temperature coefficient of resistance can be set to 300 parts per million (PPM), for example. The temperature coefficient of resistance can be stored into a memory (non-volatile memory) of the power controller 400 described later at the time of machine shipment.

Here, if the total resistance value of the resistive heat generator 360 is, for example, 10Ω, the resistance value of each of the heat generation patterns 361 to 366 is as large as 60Ω. Hence it is necessary to make the wiring of the heat generation patterns 361 to 366 dense or make the line width extremely thin, and to perform precise screen printing.

By using the heat generation patterns 361 to 366, the amount of heat generated by the PTC element decreases when the temperature of the PTC element in the non-sheet passing region increases caused by passing of a small-sized sheet, so that the temperature increase can be suppressed. With this feature, for example, for example, when paper narrower than the entire width of the heat generation patterns 361 to 366 (for example, within the width L4 of the heat generation patterns 362 to 365), each of the heat generation patterns 361 and 366 outside the paper width does not lose heat to the paper and thus increases in temperature. Then, the resistance value of each of the heat generation patterns 361 and 366 increases.

Since the voltage applied to the heat generation patterns 361 to 366 is constant, the outputs of the heat generation patterns 361 and 366 outside the sheet width are relatively lowered, to suppress the increase in the temperature of the end portion. When the heat generation patterns 361 to 366 are electrically connected in series, in order to suppress the temperature increase of the resistive heat generator outside the paper width in continuous printing, there is no method other than reducing the printing speed. By electrically connecting the heat generation patterns 361 to 366 in parallel, it is possible to suppress the temperature increase of the non-sheet passing portion while maintaining the printing speed.

Formation of Interrupting Portion by Folded Portion at Acute Angle

Figure 5A:
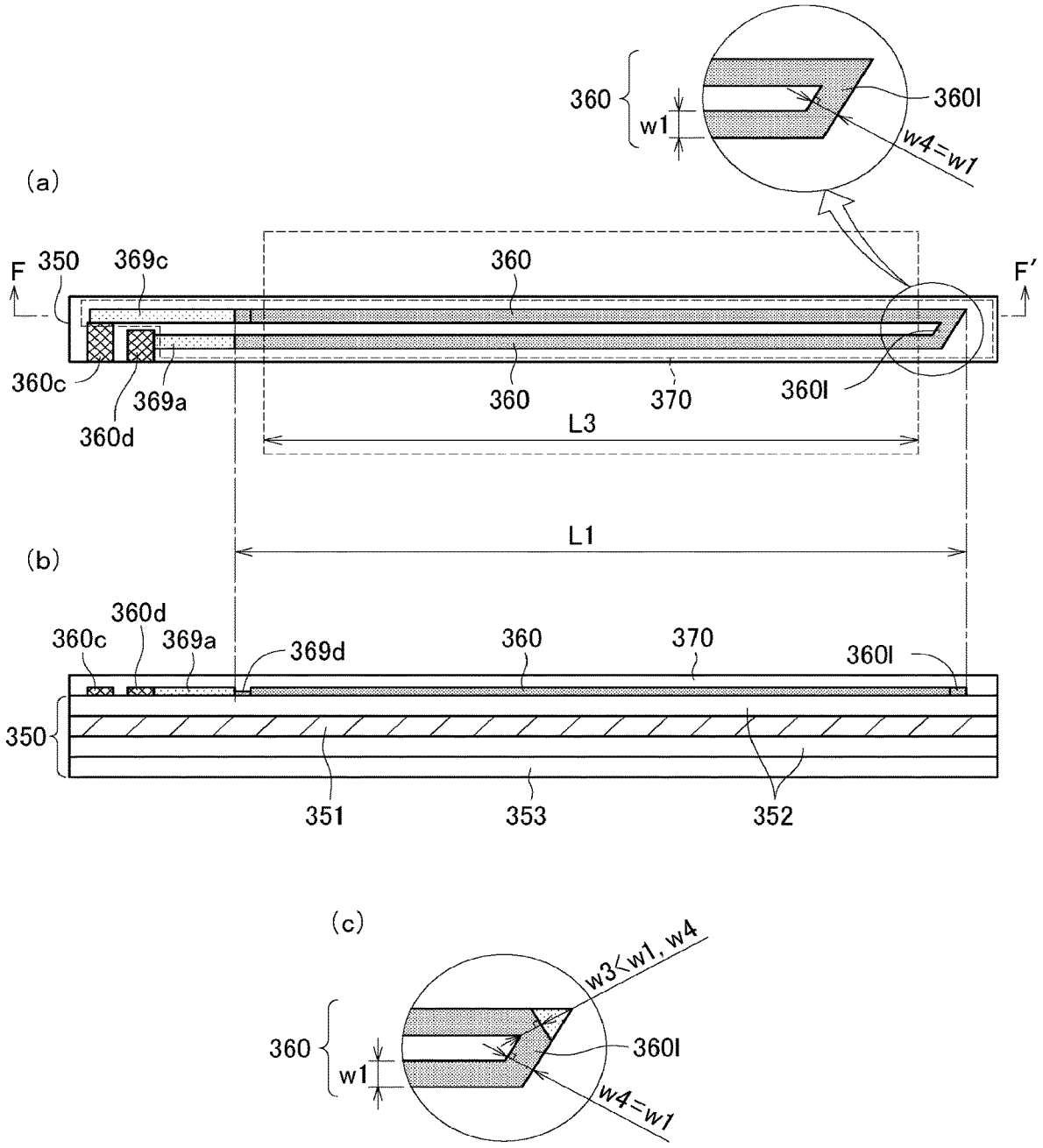
FIG. 5A is a diagram including (a) a plan view and (b) an FF' line cross-sectional view of a resistive heat generator with an interrupting portion inclined, and (c) a region in which a current of the inclined interrupting portion flows.
Figure 5B:
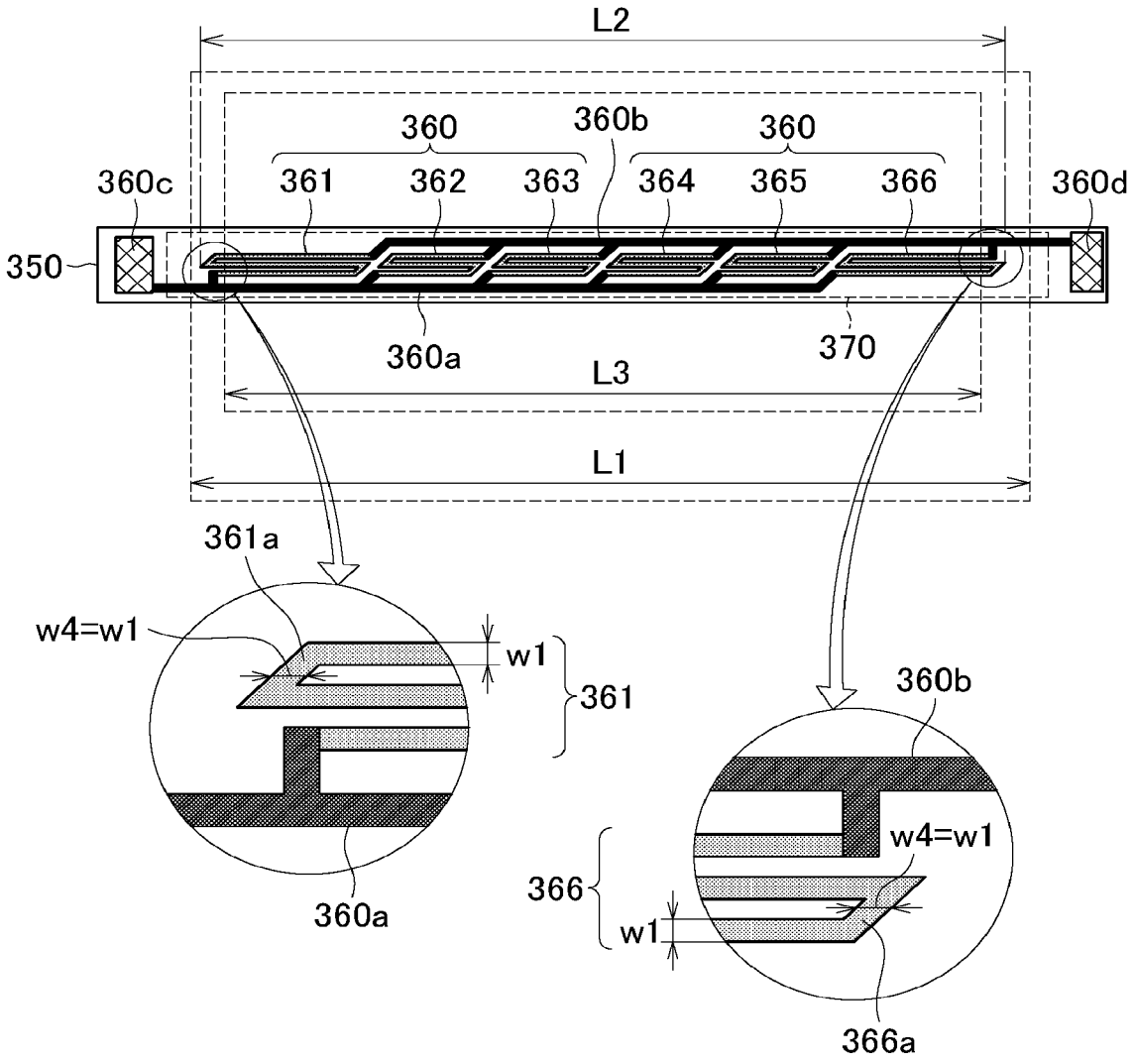
FIG. 5B is a plan view of a resistive heat generator with an interrupting portion inclined.

Next, an embodiment in which a portion bent at an acute angle is formed for each of the folded portions 360*l* and 366*a* of the resistive heat generator 360 will be described with reference to FIGS. 5A and 5B. In FIGS. 5A and 5B, the bent portion is formed so that the line width w1 of the resistance line having the maximum sheet passing width L3 is equal to a line width w4 of the resistance line of the folded portion 360*l* (w1=w4).

Further, when the line thickness of the resistive heat generator 360 with the maximum sheet passing width L3 is d1 and the line thickness of the portion inclined with respect to the longitudinal direction of the resistive heat generator 360 is d2, the bent portion is formed so that d1 is equal to d2. That is, the resistive heat generator 360 has a constant, unchanged cross-sectional area in the direction in which current flows.

The resistance line width w4 of each of the folded portions 360*l* and 366*a* is formed to be inclined with respect to a direction (belt running direction or sheet passing direction) perpendicular to the maximum sheet passing width L3. In the present embodiment, the inclination angle is about 30° in FIGS. 5A and 5B. However, the inclination angle may be changed in accordance with the interval between the two adjacent resistive heat generators 360 and 366.

Here, when each of the folded portions 360*l* and 366*a* is not inclined and is formed to be narrower or thinner than the other portions as illustrated in FIGS. 3A, 3B, 4A, and 4B, the amount of heat input into the fixing belt 310 per unit area increases in the folded portion. This increases the possibility that the fixing belt 310 is damaged due to overheating. Therefore, it is desirable to prevent the overheating damage of the fixing belt 310 by inclining the folded portion 360*l* as described above to distribute the heat transfer amount with respect to the fixing belt 310 in the belt width direction.

On the other hand, it is known that the following phenomenon occurs when an AC voltage is applied to the electrodes 360*c* and 360*d* of the resistive heat generator 360 having the folded portion 3601 bent at an acute angle as described above. That is, as illustrated in FIG. 5A(c), the resistance portion of a particular region of the acute-angle portion (the portion turning around outside) has a relatively higher resistance than the portion turning around inside.

That is, almost no current flows in the particular region. Therefore, as illustrated in FIG. 5A(c), the width w3 of the resistive heat generator 360 through which current substantially flows in the acute-angle portion is smaller than w1 and w4 (w3<w1 and w4). The same applies to the heat generation patterns 361 and 366 in FIG. 5B.

As described above, even when the resistive heat generator 360 has the same cross-sectional area in the acute-angle portion, the heat generation density increases due to the substantial reduction in cross-sectional area when current is allowed to flow. By utilizing this phenomenon, it is possible to form an interrupting portion, which is reliably disconnected due to overheating at the time of abnormality, in the acute-angle portion at the extreme end.

Divided Resistive Heat Generator

Figure 6:
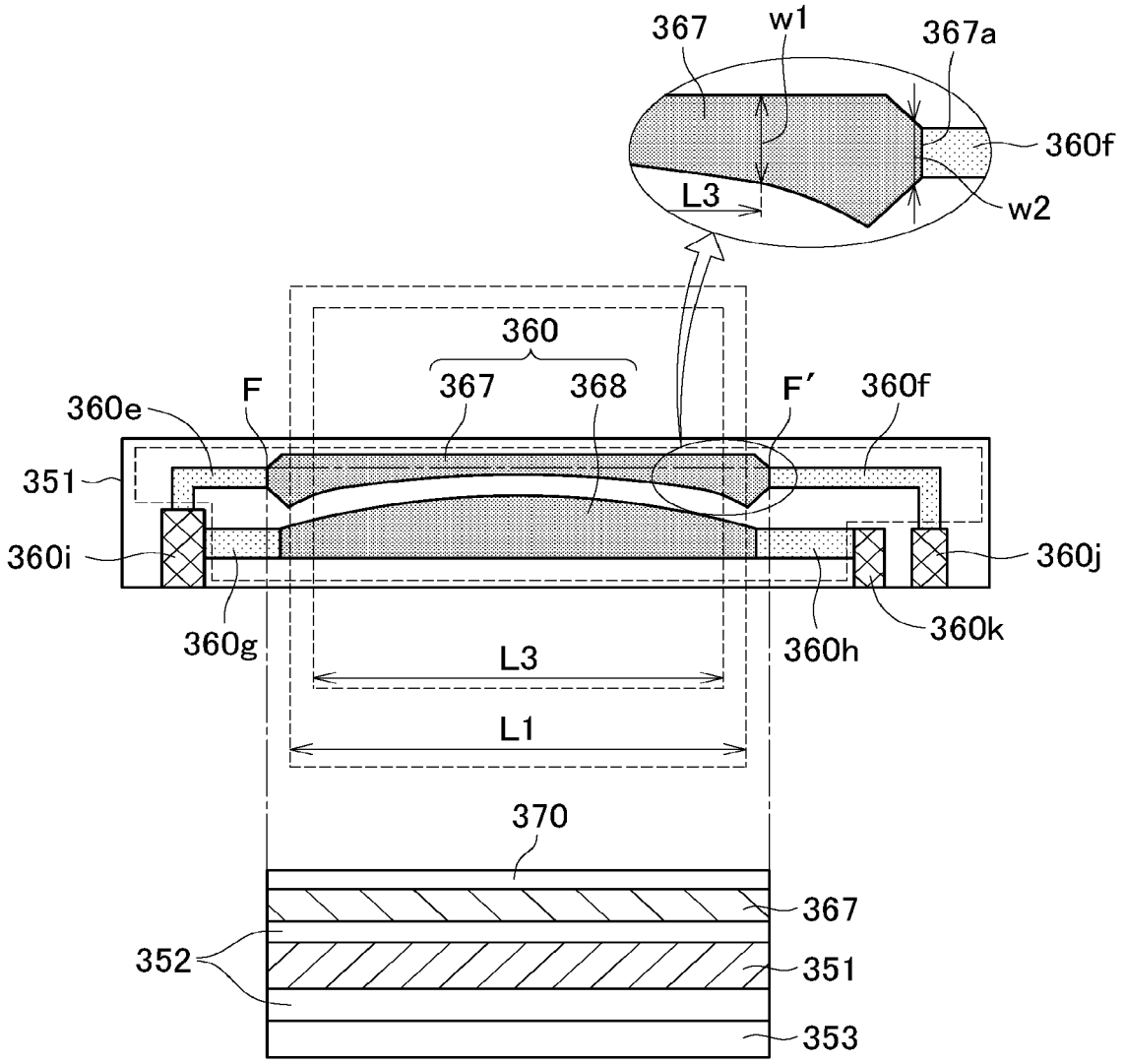
FIG. 6 is a diagram including (a) a plan view and (b) an FF' cross-sectional view of two resistive heat generators to which power is supplied individually.

The resistive heat generator 360 can be configured as a divided type in addition to the series type or the parallel type described above. The resistive heat generator 360 in FIG. 6 is formed by arranging a plurality of heat generators (two in the illustrated example), that is, a resistive heat generator 367 and a resistive heat generator 368 in the short direction of the substrate 351.

The resistive heat generator 367 on one side (the upper side in the figure) is formed so that the line width becomes narrower from the end portion to the center in the longitudinal direction. The line thickness is constant in the longitudinal direction. Therefore, the heat generation density in the longitudinal center is relatively higher than the longitudinal end portion due to the magnitude correlation of the cross-sectional area of the resistive heat generator 367 perpendicular to the power-supply direction.

On the other hand, the resistive heat generator 368 on the other side (the lower side in the figure) is formed so that the line width increases from the end portion to the center in the longitudinal direction. The thickness is constant in the longitudinal direction.

Figure 7A:
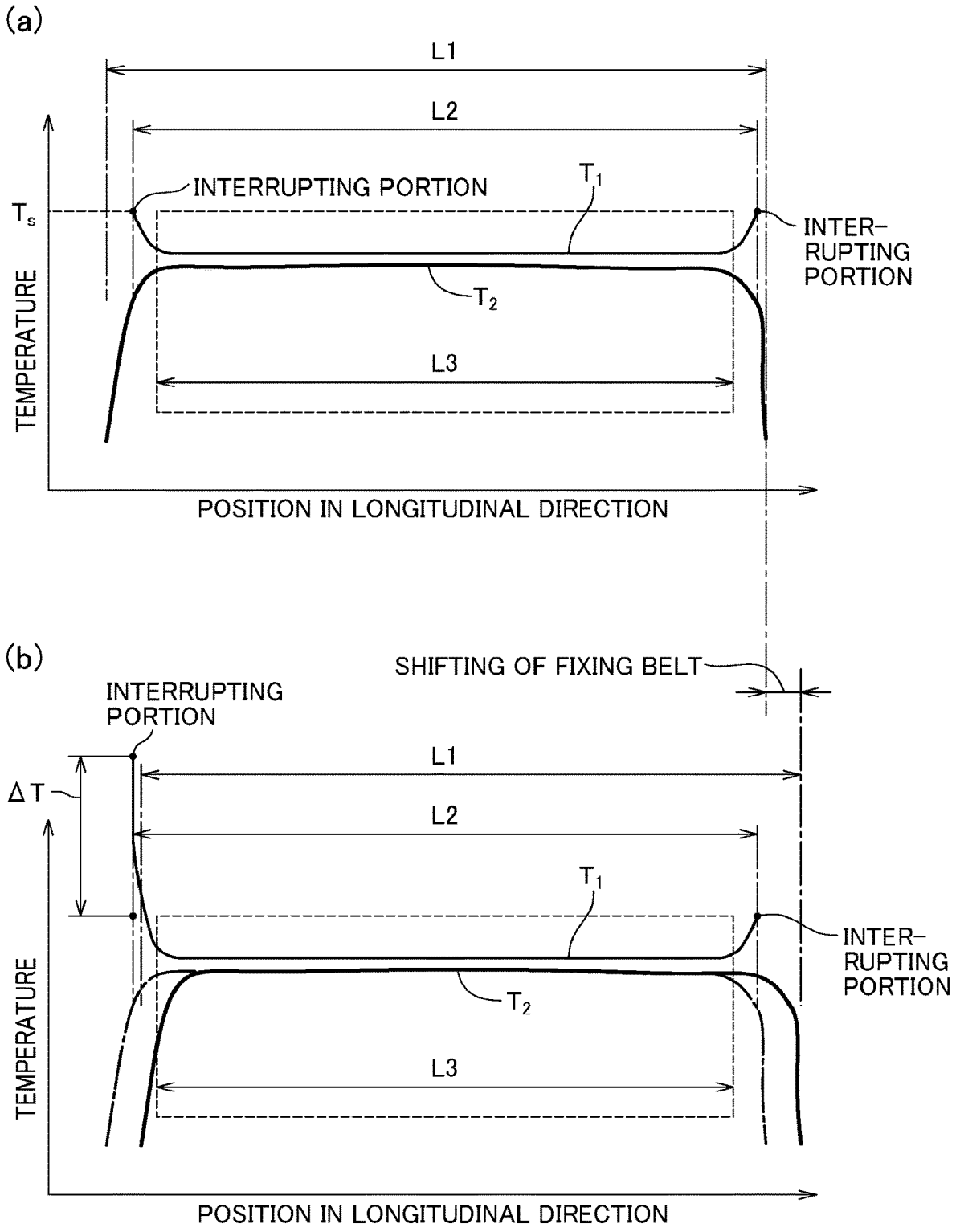
FIG. 7A is a diagram including (a) a diagram during steady running and (b) a diagram during shifting, indicating surface temperatures of a resistive heat generator and a fixing belt.

Therefore, the heat generation density in the longitudinal central is relatively lower than the longitudinal end portion due to the magnitude correlation of the cross-sectional area of the resistive heat generator 367 perpendicular to the power-supply direction. The heat generation amounts in the sheet passing direction of both the resistive heat generators 367 and 368 are made constant in the longitudinal direction when the amounts are added together. As a result, a flat belt surface temperature is obtained as illustrated in FIG. 7A(a) described later.

The resistive heat generator 367 and the resistive heat generator 368 are able to control power supply independently from electrodes 360*i* (common electrode), 360*j* and 360*k* In this way, by independently controlling the amount of power to the plurality of resistive heat generators 367 and 368, even if sheets of various sizes are allowed to pass, it is possible to suppress the temperature increase in the non-sheet passing region and ensure high productivity.

The above-described interrupting portion is formed at the extreme end of each of the plurality of resistive heat generators 367 and 368. That is, the narrow portion w2, in which the width in the direction perpendicular to the direction of the current flow (width in the sheet passing direction) is locally narrowed, is formed at each end portion of the one resistive heat generator 367 outside in the longitudinal direction of the maximum sheet passing width L3. When the line width at the extreme end of the maximum sheet passing width L3 is w1, the narrow portion w2 at each end portion is smaller than the line width w1 (w2<w1).

As a result, in the interrupting portion or the narrow portion w2 where the resistive heat generator 367 is locally narrow, the heat generation density increases due to reduction in cross-sectional area. Further, the narrow portion w2 is disposed at a position slightly outside each end portion of the other resistive heat generator 368. As a result, the end portion of the fixing belt 310 is damaged due to some abnormality, and when only the longitudinal end portion of the resistive heat generator 367 is exposed due to the shifting of the fixing belt 310, the temperature of the narrow portion w2 increases abnormally.

As a result, when the increase in resistance value of the narrow portion w2 is accelerated and the abnormal temperature increase exceeds the melting point of the glass of the protection layer 370 covering the narrow portion w2, each end of the resistive heat generator 367 is insulated as described above, and the power supply is interrupted. At this time, by detecting the disconnection (insulation) of the resistive heat generator 367, the power supply to the other resistive heat generator 368 is also interrupted. Therefore, the safety of the resistive heat generator 360 can be ensured even when the fixing belt 310 is damaged due to some abnormality.

Compatible with Metal Substrate

When metal material is used for the substrate 351 of the resistive heat generator 360 in FIG. 6, the insulation layer 352 is provided on the substrate 351, on which the resistive heat generators 367 and 368, power supply lines 360*e* to 360*h*, and electrodes 360*i* to 360*k* are formed. This ensures the insulation with the metal substrate 351. Further, the insulating protection layer 370 is provided on the resistive heat generators 367 and 368 and the power supply lines 360*e* to 360*h* to ensure the sliding and insulation with the fixing belt 310.

In the case of the resistive heat generator 360 using the metal substrate 351, it is more resistant to thermal shock due to a local temperature increase than a ceramic substrate. Therefore, as described above with reference to FIGS. 3C, 3D, 4C, and 4D, the glass of the protection layer 370 is made of a material having a melting point lower than that of the glass of the insulation layer 352, whereby the power supply is interrupted. Accordingly, when the fixing belt 310 is damaged due to some abnormality and a local temperature increase occurs at the end portion of the resistive heat generator 367, the protection layer 370 melts before the insulation layer 352.

As a result of the melting, the glass component of the protection layer 370 and the material component of the resistive heat generator 367 of the narrow portion w2 are mixed, so that the interrupting portion formed by the narrow portion w2 comes into in an insulating state, and the power supply is interrupted. On the other hand, if the insulation layer 352 has a melting point equal to or lower than the melting point of the protection layer 370, the insulation cannot be ensured between the resistive heat generator 360 and the substrate 351 due to the melting of the insulation layer 352 at the time of the local temperature increase described above.

Surface Temperature Distribution of Resistive Heat Generator and Fixing Belt

As illustrated in FIG. 7A(a), the surface temperature distribution of the fixing belt 310 is set to be constant ($T_2$) over the entire width of the maximum sheet passing width L3. The longitudinal width L2 of the resistive heat generator 360 is equal to or greater than the maximum sheet passing width L3, and a width L1 of the fixing belt is larger than L2 (L3≤L2<L1).

As a result, the temperature of the fixing belt 310 is increased via the protection layer 370 over the entire width L2 of the resistive heat generator 360 in the longitudinal direction, and the unfixed image on the sheet P having the maximum sheet passing width conveyed to the fixing nip SN is heated and can thus be fixed.

Generally, a flange is disposed at each end of the fixing belt 310 in order to restrict the longitudinal movement. A slight clearance is provided between the fixing belt 310 and the flange to reduce the friction of the fixing belt 310.

Therefore, if the fixing belt width L1 and the heat generator width L2 are made the same, when the fixing belt 310 hits one end portion of the flange, the resistive heat generator 360 is exposed without coming into contact with the fixing belt 310 on the opposite side. In this case, the resistive heat generator 360 is overheated at the end portion, and for preventing this, the dimension correlation of the fixing belt width L1>the heat generator width L2 is set in consideration of the clearance.

In addition, the sheet P to be allowed to pass may move in the longitudinal direction with respect to a target position due to skew in the process of being conveyed to the fixing device 300. Further, the longitudinal end portion of the resistive heat generator 360 tends to allow heat to escape to the outside as illustrated in FIG. 7A, and the surface temperature of the fixing belt 310 tends to decrease.

In order to prevent image defects at the longitudinal end portions due to these phenomena, the heat generator width L2≥the maximum sheet passing width L3 is set. In the present embodiment, L1 (236 mm)>L2 (222 mm)>L3 (216 mm) is set.

When configured in such a longitudinal relationship, the resistive heat generator 360 does not come into contact with the fixing belt 310 and is not exposed in normal use. However, when damage such as a crack or rounding occurs at the end portion of the fixing belt 310 due to some abnormality, the fixing belt 310 moves in the longitudinal direction more than expected, whereby the longitudinal end portion of the resistive heat generator 360 may be exposed without coming into contact with the fixing belt 310.

FIG. 7A(b) illustrates the temperature distribution of the fixing belt 310 and the resistive heat generator 360 when the width L1 of the fixing belt 310 shifts to the right. During this shifting, the resistive heat generator 360 with a low heat capacity cannot come into stable contact with the opposing pressing roller 320, and the resistive heat generator 360 is abnormally heated at the exposed portion (the left end portion in FIG. 7A(b)) by ΔT, which leads to melting/fuming of a heater holder and the surface layer of the pressing roller 320.

Therefore, in the present embodiment, the interrupting portions are formed at both end portions of the resistive heat generator 360 as described above. The amount of heat generated in the interrupting portion at each longitudinal end portion is locally increased as described above, and hence the surface temperature of the resistive heat generator 360 is higher at each end portion than the center in the longitudinal direction even during the steady running of the fixing belt 310.

Since each end portion having the high temperature is always in contact with the fixing belt 310 during the steady running of the fixing belt 310, the stable temperature $T_S$ of the end portion in FIG. 7A(a) is maintained. In this state, the glass of the protection layer 370 does not melt and the power supply state of the interrupting portion is also maintained.

However, when the fixing belt 310 shifts in the width direction due to damage such as cracks or rounding at the end portion of the fixing belt 310, as illustrated in FIG. 7A(b), the temperature of the interrupting portion on the exposed side of the resistive heat generator 360 (the left end portion of FIG. 7A(b)) increases rapidly from $T_1$ (resulting in an abnormal temperature increase $\Delta T$). As a result, the glass component of the protection layer 370 melts and reacts with the material component of the interrupting portion, so that the interrupting portion becomes an insulator.

The glass of the protection layer 370 is preferably at least one of a Pb-based amorphous glass and a Bi-based amorphous glass so that the glass of the protection layer 370 melts into an insulator. PbO—$B_2O_3$-based glass or the like can be used as the Pb-based glass, and $Bi_2O_3$—ZnO—$B_2O_3$-based glass can be used as the Bi-based glass.

In addition, Ag-based amorphous glass (for example, AgO—$P_2O_5$-based), $P_2O_5$—$SnO_2$—ZnO-based glass, ZnO—$B_2O_3$-based glass, and the like can also be used. The glass may be crystallized glass or amorphous glass.

Method for Measuring Surface Temperature of Resistive Heat Generator

Figure 7B:
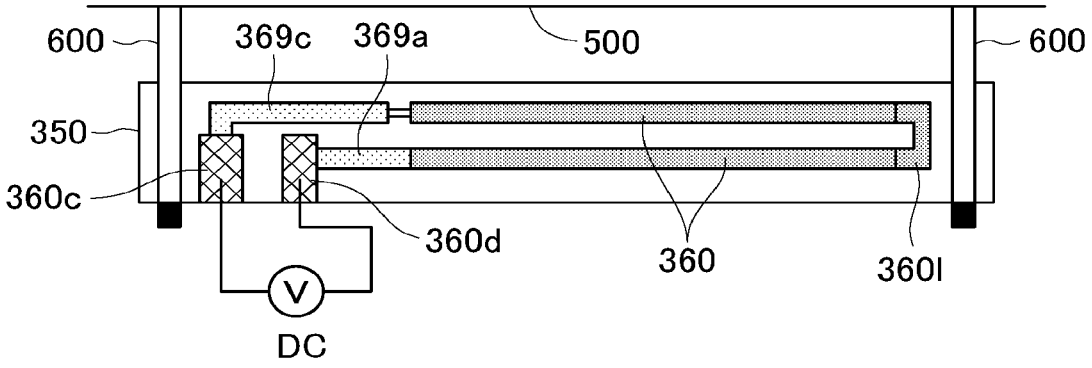
FIG. 7B is a diagram illustrating a method for measuring the temperature of the resistive heat generator.

The surface temperature of the resistive heat generator 360 illustrated in FIG. 7A can be measured by the method illustrated in FIG. 7B, for example. That is, both ends of the heating device are supported by the support beam 500 via a suspension member 600, and a thermoviewer (for example, FLIR T620 manufactured by FLIR Systems, Inc.) is disposed in front of the resistive heat generator 360. Then, the AC power source or the direct current (DC) power source is connected to each of the electrodes 360*c* and 360*d* to supply power to and heat the resistive heat generator 360.

In the case of a heater having a calorific value of 1000 W at 100 VAC, 30 V DC can be used as the DC power source. The upper curve in FIG. 7A is the temperature of the resistive heat generator 360 measured with the thermoviewer. Meanwhile, the temperature curve of the fixing belt 310 illustrated in the lower side of FIG. 7A can be measured by a temperature sensor illustrated in FIGS. 8A to 8D described later.

Measurement Method of Heat Generation Density

The relationship between the heat generation density [W/mm$^2$] and the temperature [° C.] of the resistive heat generator 360 can be expressed by the following equation (1).

$$\text{Temperature}=(\text{Heat generation density}/\text{Heat transfer coefficient})+\text{Air temperature around the part} \quad (1)$$

Therefore, the heat transfer coefficient of the resistive heat generator 360 and the air temperature around the heater can be measured almost constant. The magnitude of the heat generation density [W/mm$^2$] can be measured by the magnitude of the heater temperature [° C.] during power supply.

The temperature distribution on the surface of the heater upon power supply of DC 30 V is measured with a thermoviewer (for example, FLIR T620 manufactured by FLIR Systems, Inc.). A comparison is then made between the temperature at the extreme end of the resistive heat generator 360 and the temperature at the extreme end of the maximum sheet passing width after the lapse of a certain time (for example, after 10 seconds) from power supply, thereby enabling indirect calculation of the magnitude of the heat density [W/mm$^2$].

Electric Power Supply Circuit

Figure 9:
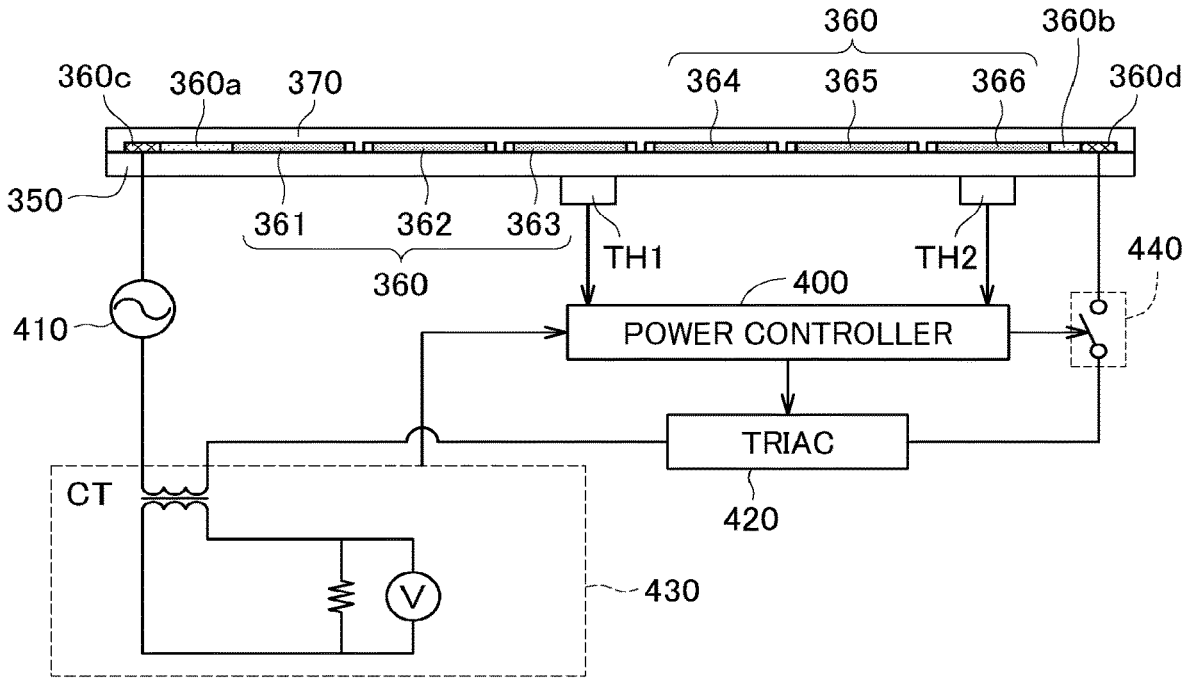
FIG. 9 is a diagram illustrating a heating device, an electric power supply circuit, and a power controller.

FIG. 9 illustrates an electric power supply circuit for supplying electric power to the heating device. Here, the resistive heat generator 360 of the heating device uses the heat generation patterns 361 to 366 formed of the PTC elements of FIGS. 4A to 4D. An electric power supply circuit for supplying electric power to the resistive heat generator 360 or the heat generation patterns 361 to 366 is illustrated below the heating device.

The electric power supply circuit includes a power controller 400 serving as power control circuitry, the AC power source 410 with an AC voltage of 100 V, a triac 420, an electric current detector 430, a heater relay 440, a voltage sensor, and a controller unit. The AC power source 410, a current transformer CT of the electric current detector 430, the triac 420, and the heater relay 440 are disposed in series between the electrodes 360*c* and 360*d*.

Temperature Sensor

The heating device of the present embodiment has the first temperature sensor TH1 and the second temperature sensor TH2 as temperature sensing unit for detecting the temperature of the resistive heat generator 360 as illustrated in FIG. 9. Each of the temperature sensors TH1 and TH2 can be formed of, for example, a thermistor.

As illustrated in FIG. 2A, the first temperature sensor TH1 and the second temperature sensor TH2 are disposed so as to be crimped to the back side of the base 350 by a spring 380. The first temperature sensor TH1 is for temperature control, and the second temperature sensor TH2 is for safety compensation. The two temperature sensors TH1 and TH2 can both be formed of contact thermistors having a thermal time constant of less than 1 second.

As illustrated in FIG. 9, the first temperature sensor TH1 for temperature control is disposed in the heating region of the fourth heat generation pattern 364 from the left end of the central region in the longitudinal direction within the minimum sheet passing width. The second temperature sensor TH2 for safety compensation is disposed in the heating region of the heat generation pattern 366 (sixth from the left end) (or the heat generation pattern 361 (first from the left end)), which is the extreme end in the longitudinal direction.

Both of the two temperature sensors TH1 and TH2 are arranged in the region of the heat generation patterns 364 and 366 that avoid the gap between the resistive heat generators in which the heat generation amount decreases. Thereby, the temperature controllability is improved, and when some resistive heat generators are disconnected, the disconnection can be detected easily.

The first temperature sensor TH1 may be disposed in any heating region of the heat generation patterns 362 to 365. Further, the second temperature sensor TH2 can be disposed in the heating region of the second heat generation pattern 362 or the fifth heat generation pattern 365 from the left end so long as being in the region at the longitudinal end. It is not necessarily required to dispose the second temperature sensor TH2 at the longitudinal end.

Temperatures $T_4$ and $T_6$ detected by the first temperature sensor TH1 and the second temperature sensor TH2 are input into the power controller 400. Based on the temperature $T_4$ obtained from the first temperature sensor TH1, the power controller 400 performs duty control on the supply current to the electrodes 360*c* and 360*d* is duty-controlled by the triac 420 so that the heat generation patterns 361 to 366 have predetermined target temperatures.

Specifically, the current flowing through the resistive heat generator 360 is duty-controlled by the triac 420 at a duty ratio corresponding to the temperature difference between the current temperature $T_4$ of the first temperature sensor TH1 and the target temperature. The current becomes zero at a duty ratio of 0%, and the current becomes maximum at a duty ratio of 100%.

Fixing Operation

The fixing operation will be described with reference to FIG. 2A as a representative of the fixing devices 300 of FIGS. 2A to 2E. In FIG. 2A, when the sheet P is allowed to pass from the direction of the arrow toward the fixing nip SN, the sheet P is heated between the fixing belt 310 and the pressing roller 320 and a toner image is fixed onto the sheet P. At this time, the fixing belt 310 is heated by the heat from the resistive heat generator 360 while sliding with the protection layer 370 of the resistive heat generator 360.

Figure 8A:
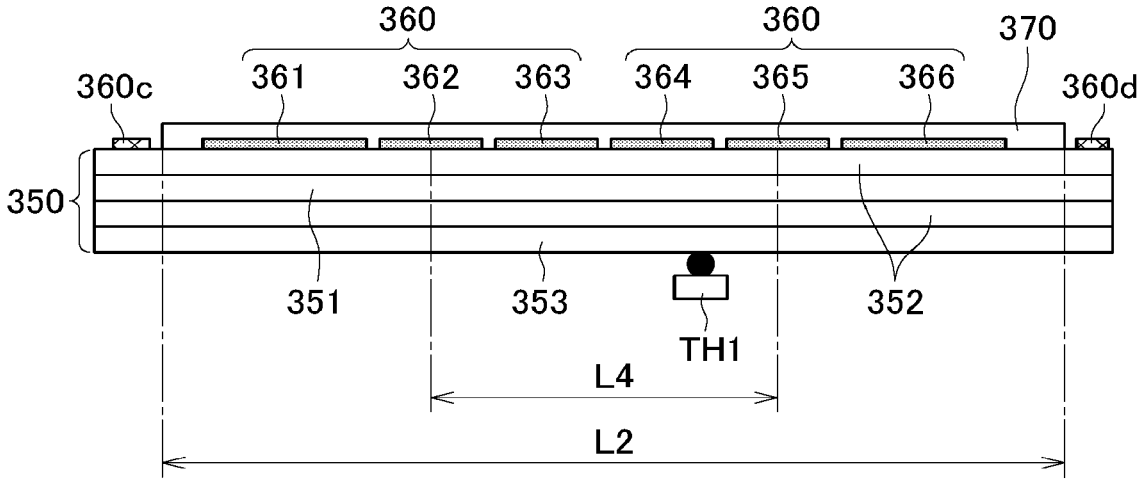
FIG. 8A is a cross-sectional view of a resistive heat generator with one temperature sensor.

In the temperature control of the resistive heat generator 360 for setting the fixing belt 310 to a predetermined temperature, in a case where only the first temperature sensor TH1 is disposed as illustrated in FIG. 8A, when only the heat generation pattern 364 in which the first temperature sensor TH1 is disposed is partially disconnected and the power supply is interrupted, the temperature of the heat generation pattern 364 does not increase. For this reason, in order to keep the heat generation pattern 364 at a constant temperature by temperature control, the current is continuously supplied more than necessary to the other normal heat generation patterns 361 to 363 and 365 to 366, resulting in generation of an abnormally high temperature.

Figure 8B:
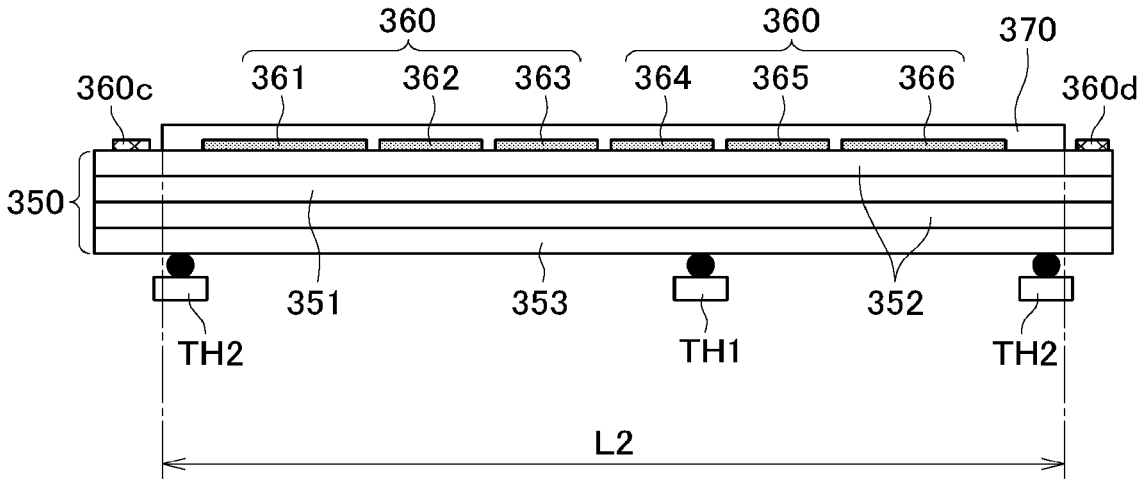
FIG. 8B is a cross-sectional view of a resistive heat generator with three temperature sensors.
Figure 8C:
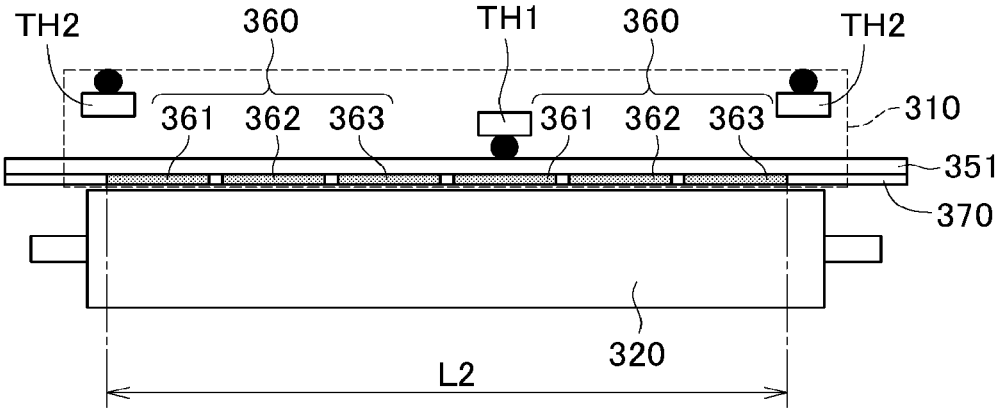
FIG. 8C is a cross-sectional view of a resistive heat generator with three temperature sensors.
Figure 8D:
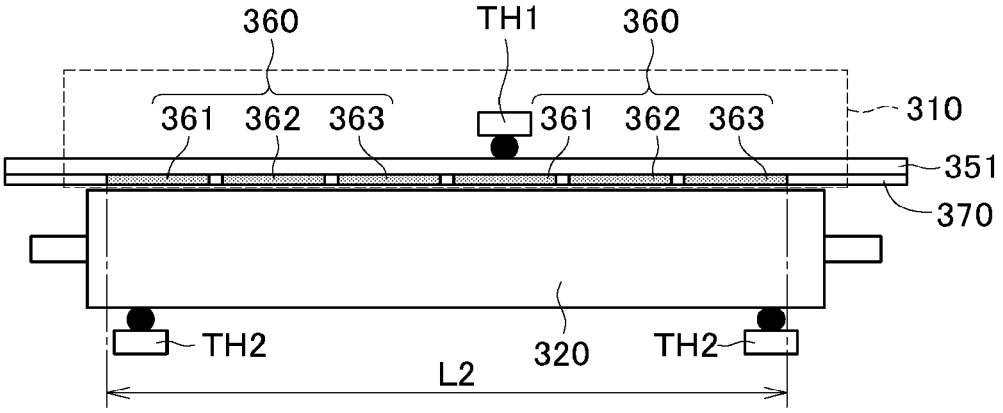
FIG. 8D is a cross-sectional view of a resistive heat generator with three temperature sensors.

FIGS. 8B to 8D illustrate arrangement patterns of temperature sensors that can be considered to prevent abnormally high temperatures. If the temperature sensor TH1 is disposed only at the position corresponding to the heat generation pattern 364 as illustrated in FIG. 8A, the above-described disadvantages occur. Hence the temperature sensors TH2 are also provided at both end portions as illustrated in FIGS. 8B to 8D.

FIG. 8B illustrates the temperature sensors TH1 and TH2 disposed at the center and both end portions of the back surface of the base 350. In FIG. 8C, the temperature sensor TH1 is disposed at the center of the back surface of the base 350, and the temperature sensors TH2 have been brought into contact with the inner peripheral surfaces of both ends of the fixing belt 310.

In FIG. 8D, the temperature sensors TH2 at both end portions have been brought into contact with the outer peripheral surfaces of both end portions of the pressing roller 320. As described above, it is possible to indirectly detect the temperatures of the heat generation patterns 361 and 364 via the fixing belt 310 and the pressing roller 320. However, if three temperature sensors TH1 and TH2 are disposed as illustrated in FIGS. 8B to 8D, the cost increases.

Therefore, the second temperature sensor TH2 is disposed only in the heating region of the heat generation pattern 366 at one end portion, and the temperature $T_6$ of the heat generation pattern 366 is detected by the second temperature sensor TH2. When the temperature $T_6$ becomes the abnormally high temperature described above, the power controller 400 controls the triac 420 so as to interrupt the supply current to the electrodes 360*c* and 360*d*. Further, even when the temperature of the second temperature sensor TH2 itself becomes the predetermined temperature $T_N$ or lower ($T_6<T_N$) due to disconnection, the power controller 400 controls the triac 420 so as to interrupt the supply current to the electrodes 360*c* and 360*d*.

Heating Device Control Flowchart

Figure 10:
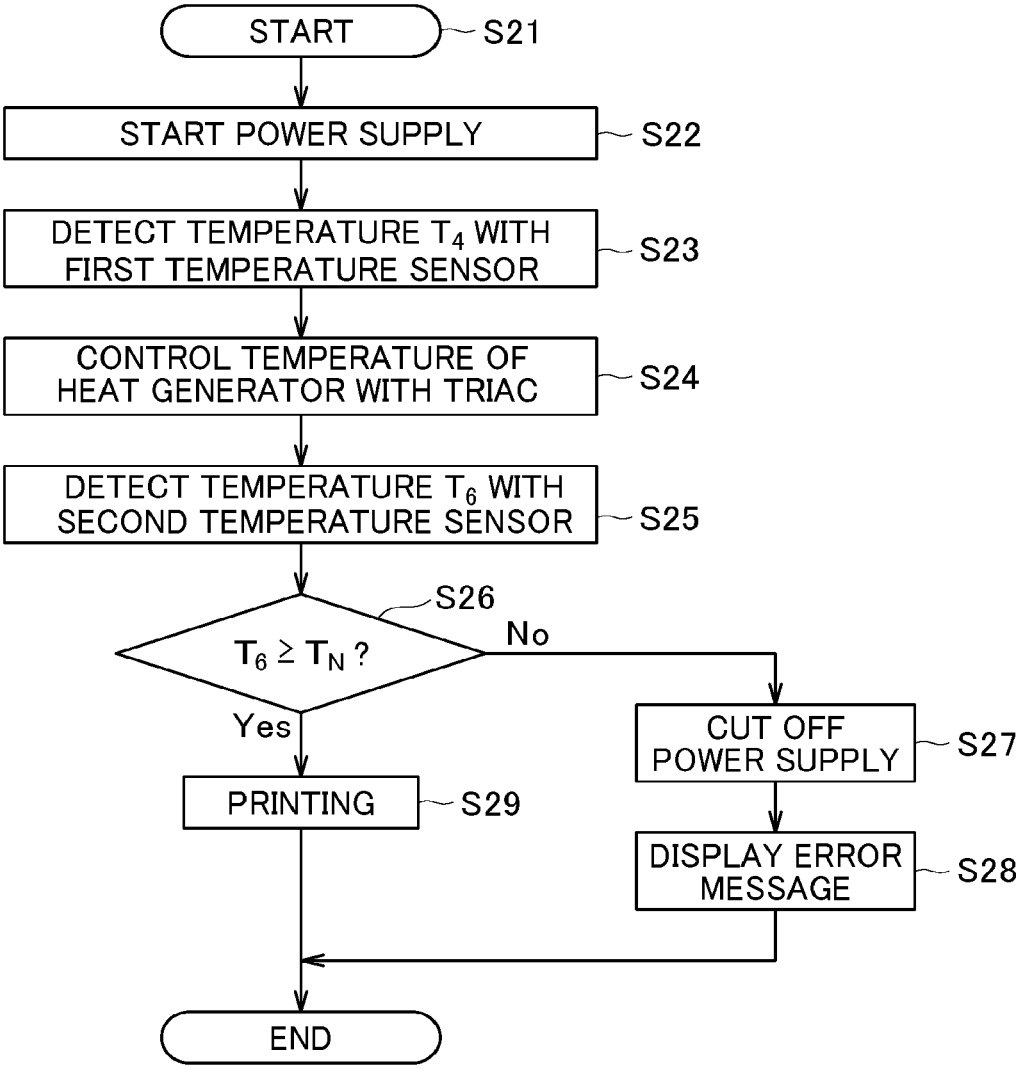
FIG. 10 is a flowchart illustrating a control operation of the heating device, performed by a temperature sensor.

FIG. 10 is a flowchart illustrating the above-described control operation of the heating device by the first temperature sensor TH1 and the second temperature sensor TH2. In step S21 in FIG. 10, the image forming apparatus 100 is instructed to execute a print job.

Then, in step S22, the power controller 400 starts to supply power from the AC power source 410 to each of the heat generation patterns 361 to 366 of the resistive heat generator 360. In step S23, the first temperature sensor TH1 detects the temperature $T_4$ of the heat generation pattern 364 located in the central region of the resistive heat generator 360.

Next, in step S24, the temperature control of the resistive heat generator 360 by the triac 420 is started. In step S25, the temperature $T_6$ of the heat generation pattern 366 is detected by the second temperature sensor TH2.

Then, in step S26, it is determined whether or not temperature $T_6 \geq T_N$ ($T_N$: predetermined temperature). When $T_6<T_N$, the occurrence of an abnormally low temperature (occurrence of disconnection) is determined. In step S27, the triac 420 is controlled by the power controller 400 so that the power supply to the resistive heat generator 360 is substantially interrupted. In step S28, an error message is displayed on the operation panel of the image forming apparatus 100. Note that the triac 420 may be similarly controlled so that the power supply to the resistive heat generator 360 is interrupted (OFF) when the temperature $T_6$ of the second temperature sensor TH2 becomes abnormally high.

When $T_6 \geq T_N$, it is determined that no abnormally low temperature has occurred, and the printing operation is started in step S29. As described above, by operating the power controller 400 in the flowchart of FIG. 10 using the second temperature sensor TH2, the safety of the fixing device 300 is further enhanced in combination with the interrupting portion of the heating device described above.

As described above, although the present invention has been illustrated based on the above-described embodiments, it goes without saying that the present invention is not limited to the above-described embodiments, and can be variously changed within the scope of the technical idea as described in the claims. For example, the interrupting portion may be configured by using a material having a specific resistance value larger than that of other portions of the heater.

When the specific resistance of the interrupting portion is increased, the amount of heat generated increases in the same manner as when the cross-sectional area is decreased. Thus, during the shifting of the fixing belt 310, the temperature of the end portion of the heater quickly increases, and the interrupting portion is disconnected. That is, by increasing the specific resistance, it is possible to form an interrupting portion which is reliably disconnected due to overheating in the event of an abnormality.

Even when the interrupting portion is formed only at one end portion in the longitudinal direction of the heater, the minimum safety can be ensured.

The heating device according to an embodiment of the present disclosure can be used for a drying device using a belt in addition to being used for a fixing device of an image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A heating device, comprising:

a heater extending in a width direction of a rotary belt and configured to contact and heat the belt; and an interrupting portion configured to interrupt power supply at a longitudinal end portion of the heater, wherein the interrupting portion is inclined with respect to a running direction of the belt.

2. The heating device according to claim 1, wherein the interrupting portion is disposed at a position at which the interrupting portion contacts the belt during steady running of the belt and does not contact the belt during shifting of the belt to one side in the width direction.

3. The heating device according to claim 1, wherein the interrupting portion has a smaller cross-sectional area than a cross-sectional area of another portion of the heater in a direction crossing a direction in which current flows.

4. The heating device according to claim 3, wherein the heater includes:

a base;

a resistive heat generator on the base; and a protection layer covering the resistive heat generator, and wherein a line width of the resistive heat generator in the interrupting portion is narrower than a line width of another portion in the interrupting portion.

5. The heating device according to claim 4, wherein the resistive heat generator of the heater has a resistance line linearly extending in a longitudinal direction of the base.

6. The heating device according to claim 5, wherein the interrupting portion includes a bent portion in which a part of the resistance line is bent at an acute angle.

7. The heating device according to claim 4, wherein the resistive heat generator of the heater has a resistance line meandering in a short direction of the base.

8. The heating device according to claim 7, further comprising a plurality of heat generation patterns, each including the resistance line meandering in a longitudinal direction of the base, wherein the plurality of heat generation patterns is connected in parallel.

9. The heating device of claim 8, further comprising:

a first temperature sensor disposed at a position corresponding to a heat generation pattern a middle in the longitudinal direction of the base among the plurality of heat generation patterns;

a second temperature sensor disposed at a position corresponding to a heat generation pattern at an end portion in the longitudinal direction of the base among the plurality of heat generation patterns; and power control circuitry configured to control current supplied from the heater based on detection results of the first temperature sensor and the second temperature sensor.

10. The heating device according to claim 4, wherein the heater includes a plurality of resistive heat generators, including the resistive heat generator, to be separately supplied with power.

11. The heating device according to claim 3, wherein the heater includes:

a base;

a resistive heat generator formed on the base; and a protection layer covering the resistive heat generator, and, wherein a line thickness of the resistive heat generator in the interrupting portion is smaller than a line thickness of another portion in the interrupting portion.

12. The heating device according to claim 1, wherein the interrupting portion has a specific resistance larger than a specific resistance of another portion of the heater.

13. A fixing device comprising:

a fixing belt;

the heating device according to claim configured to heat the fixing belt; and a pressure member disposed to face the heating device across the fixing belt.

14. An image forming apparatus comprising the fixing device according to claim 13.

15. A heating device, comprising:

a heater extending in a width direction of a rotary belt and configured to contact and heat the belt; and an interrupting portion configured to interrupt power supply at a longitudinal end portion of the heater, wherein the interrupting portion is disposed at a position at which the interrupting portion contacts the belt during steady running of the belt and does not contact the belt during shifting of the belt to one side in the width direction.

16. A heating device, comprising:

a heater extending in a width direction of a rotary belt and configured to contact and heat the belt; and an interrupting portion configured to interrupt power supply at a longitudinal end portion of the heater, wherein the heater includes a base, a resistive heat generator on the base; and a protection layer covering the resistive heat generator, a line width of the resistive heat generator in the interrupting portion is narrower than a line width of another portion in the interrupting portion, and the resistive heat generator of the heater has a resistance line meandering in a short direction of the base.

* * * * *